US011437701B2

(12) United States Patent
Rai et al.

(10) Patent No.: US 11,437,701 B2
(45) Date of Patent: Sep. 6, 2022

(54) MACRO-CELL RADIO AND ANTENNA MODULES

(71) Applicant: CommScope Design & Integration UK Limited, Fife (GB)

(72) Inventors: Dipen Rai, London (GB); Ali Mirza, Guildford (GB); Steven Lock, Guildford (GB)

(73) Assignee: CommScope Design & Integration UK Limited, Fife (GB)

( * ) Notice: Subject to any disclaimer, the term of this patent is extended or adjusted under 35 U.S.C. 154(b) by 59 days.

(21) Appl. No.: 17/189,467

(22) Filed: Mar. 2, 2021

(65) Prior Publication Data

US 2021/0336331 A1 Oct. 28, 2021

Related U.S. Application Data

(60) Provisional application No. 63/069,783, filed on Aug. 25, 2020, provisional application No. 63/014,399, filed on Apr. 23, 2020.

(51) Int. Cl.
*H01Q 1/02* (2006.01)
*H01Q 1/44* (2006.01)
(Continued)

(52) U.S. Cl.
CPC ..... *H01Q 1/02* (2013.01); *H01Q 1/125* (2013.01); *H01Q 1/1242* (2013.01);
(Continued)

(58) Field of Classification Search
CPC ..... H01Q 1/1242; H01Q 1/02; H01Q 1/125; H01Q 1/246; H01Q 1/42; H01Q 1/44; H01Q 21/28; H01Q 23/00
See application file for complete search history.

(56) References Cited

U.S. PATENT DOCUMENTS 10,886,595 B1 1/2021 Ortel et al.
2017/0214113 A1 7/2017 Norrell et al.
(Continued)

FOREIGN PATENT DOCUMENTS

CN 204424421 U 6/2015
CN 204596939 U 8/2015
(Continued)

OTHER PUBLICATIONS

PCT Notification of Transmittal of the International Search Report and the Written Opinion of the International Searching Authority, or the Declaration, dated Jun. 21, 2021, for corresponding PCT International Application No. PCT/US2021/020486.
(Continued)

*Primary Examiner* — Robert Karacsony
(74) *Attorney, Agent, or Firm* — Myers Bigel, P.A.

(57) ABSTRACT

The present disclosure describes an antenna module. The antenna module including an antenna-radio unit comprising a first antenna and a radio transceiver in an integrated unit, a second antenna, a foundation plate configured for mounting to a monopole, a bottom plate mounted above the foundation plate to form a first air gap, a first support member and a second support member, the first support member extending upwardly from the bottom plate and is secured to the second support member such that a second air gap is formed therebetween, wherein the antenna-radio unit is mounted to one support member and the second antenna is mounted to the other support member, a divider plate mounted to one of the support members such that the divider plate separates the antenna module into a top compartment and a bottom compartment, an upper plate mounted to an upper end of the second support member, a fan unit mounted to the upper plate, a lower cap mounted above the upper plate, an upper cap mounted above the lower cap to form a
(Continued)

third air gap, and a shroud that surrounds and conceals the antenna-radio unit, the second antenna, the divider plate, and the support members.

20 Claims, 20 Drawing Sheets

(51) Int. Cl.

| | |
|---|---|
| ***H01Q 1/42*** | (2006.01) |
| ***H01Q 1/12*** | (2006.01) |
| ***H01Q 1/24*** | (2006.01) |
| ***H01Q 23/00*** | (2006.01) |
| ***H01Q 21/28*** | (2006.01) |

(52) U.S. Cl.
CPC ..... *H01Q 1/246* (2013.01); *H01Q 1/42* (2013.01); *H01Q 1/44* (2013.01); *H01Q 21/28* (2013.01); *H01Q 23/00* (2013.01)

(56) References Cited

U.S. PATENT DOCUMENTS

| | | | |
|---|---|---|---|
| 2018/0254545 | A1 | 9/2018 | Hendrix et al. |
| 2018/0277921 | A1 | 9/2018 | Ming et al. |
| 2019/0267700 | A1 | 8/2019 | Hendrix et al. |
| 2019/0273313 | A1 | 9/2019 | Schwartz |
| 2020/0136236 | A1 | 4/2020 | Colapietro et al. |
| 2021/0313665 | A1 | 10/2021 | Hoganson |

FOREIGN PATENT DOCUMENTS

| | | | |
|---|---|---|---|
| CN | 208753503 | U | 4/2019 |
| CN | 110492216 | A | 11/2019 |
| CN | 110792312 | A | 2/2020 |
| WO | 2018114510 | A1 | 6/2018 |

OTHER PUBLICATIONS

"ESB Sistemas, "Camouflage Hybrid Antenna 2/3/4/5G New Product Release," ESB Sistemas Espana S.L., May 2020, Available online at: www.esbsistemas.com".

"PCT Notification of Transmittal of the International Search Report and the Written Opinion of the International Searching Authority, or the Declaration, dated Jul. 1, 2021, for corresponding PCT International Application No. PCT/EP2021/059027."

MACRO-CELL RADIO AND ANTENNA MODULES

RELATED APPLICATION(S)

The present application claims priority to and the benefit of U.S. Provisional Application Ser. No. 63/014,399, filed Apr. 23, 2020, and U.S. Provisional Application Ser. No. 63/069,783, filed Aug. 25, 2020, the disclosures of which are hereby incorporated herein in their entireties.

FIELD

The present application is directed generally toward telecommunications equipment, and more particularly, mounting structures for communications antennas.

BACKGROUND

As wireless data service demands have grown, a conventional response has been to increase the number and capacity of conventional cellular Base Stations (Macro-Cells). The antennas used by such Macro-Cells are typically mounted on antenna towers. A conventional antenna tower has three or four legs on which antennas and supporting remote radio units (RRUs) are mounted. However, in some environments, structures known as "monopoles" are used as mounting structures. Monopoles are typically employed when fewer antennas/RRUs are to be mounted, and/or when a structure of less height is required.

In addition, Macro-Cell sites are becoming less available, and available spectrum limits how much additional capacity can be derived from a given Macro-Cell. Accordingly, small cell RRU and antenna combinations have been developed to "fill in" underserved or congested areas that would otherwise be within a Macro-Cell site. Deployment of small cells, particularly in urban environments, is expected to continue to grow. Often such small cell configurations (sometimes termed "metrocells") are mounted on monopoles.

In view of the foregoing, it may be desirable to provide additional monopole arrangements for either Macro-cell or metrocell sites.

SUMMARY

A first aspect of the present invention is directed to an antenna module. The antenna module may include an antenna-radio unit including a first antenna and a radio transceiver in an integrated unit; a second antenna; a foundation plate configured for mounting to a monopole; a bottom plate mounted above the foundation plate to form a first air gap; a first support member and a second support member, the first support member extending upwardly from the bottom plate and is secured to the second support member such that a second air gap is formed therebetween, wherein the antenna-radio unit is mounted to one support member and the second antenna is mounted to the other support member; a divider plate mounted to one of the support members such that the divider plate separates the antenna module into a top compartment and a bottom compartment; an upper plate mounted to an upper end of the second support member; a fan unit mounted to the upper plate; a lower cap mounted above the upper plate; an upper cap mounted above the lower cap to form a third air gap; and a shroud that surrounds and conceals the antenna-radio unit, the second antenna, the divider plate, and the support members.

Another aspect of the present invention is directed to a monopole assembly. The monopole assembly may include an elongate monopole and an antenna module. The antenna module may include an antenna-radio unit including a first antenna and a first radio transceiver in an integrated unit; a second antenna; a foundation plate configured for mounting to the monopole; a bottom plate mounted above the foundation plate to form a first air gap; a first support member and a second support member, the first support member extending upwardly from the bottom plate and is secured to the second support member such that a second air gap is formed therebetween, wherein the antenna-radio unit is mounted to one support member and the second antenna is mounted to the other support member; a divider plate mounted to one of the support members such that the divider plate separates the module into a top compartment and a bottom compartment; an upper plate mounted to an upper end of the second support member; a fan unit mounted to the upper plate; a lower cap mounted above the upper plate; an upper cap mounted above the lower cap to form a third air gap; and a shroud that surrounds and conceals the antenna-radio unit, the second antenna, the divider plate, and the support member; and a second radio transceiver mounted outside of the module and connected to the second antenna.

Another aspect of the present invention is directed to an antenna module assembly. The antenna module assembly includes a passive antenna module and an active antenna module. The passive antenna module includes three passive antennas, a foundation plate configured for mounting to a structure, a bottom plate mounted above the foundation plate to form an air gap, a first support member extending upwardly from the bottom plate, wherein the three passive antennas are mounted to the first support member, and three shroud members that together surround the passive antennas. The active antenna module includes three antenna-radio units, each antenna-radio unit comprising an antenna and a radio transceiver in an integrated unit, a second bottom plate, a second support member extending upwardly from the second bottom plate, wherein the antenna-radio units are mounted to the second support member, an upper plate mounted to an upper end of the second support member, a fan unit mounted to the upper plate; and three shroud members that together surround the antenna-radio units. The active and passive antenna modules are configured such that the modules may be mounted to a structure and used as separate units or the active antenna module may be combined with the passive antenna module in a stacked relationship.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
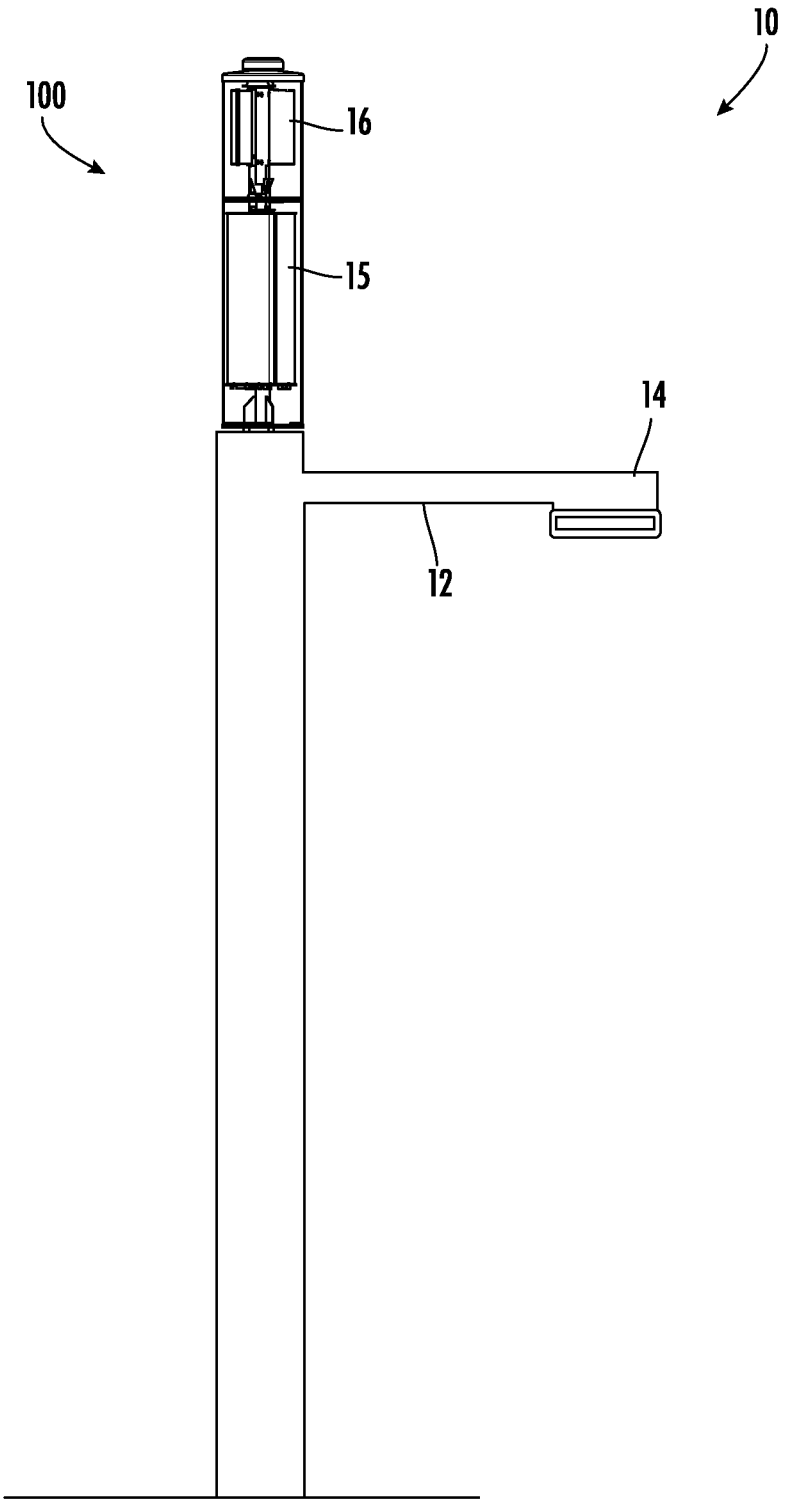
FIG. 1 is a front view of a typical monopole on which an antenna module according to embodiments of the present invention may be mounted.
Figure 2A:
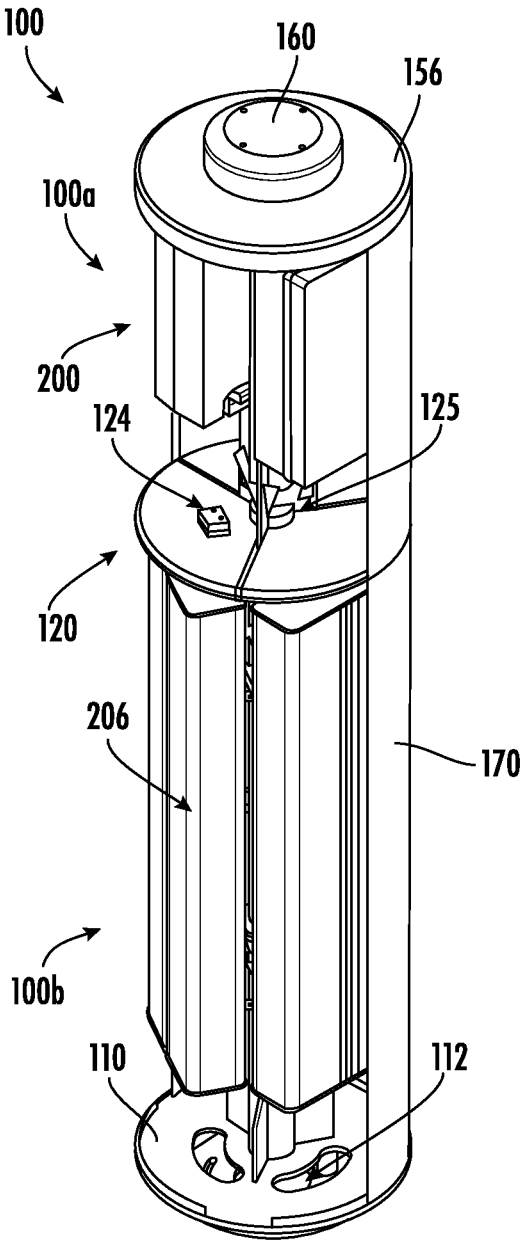
FIG. 2A is a front perspective cutaway view of an antenna module according to embodiments of the present invention.
Figure 2B:
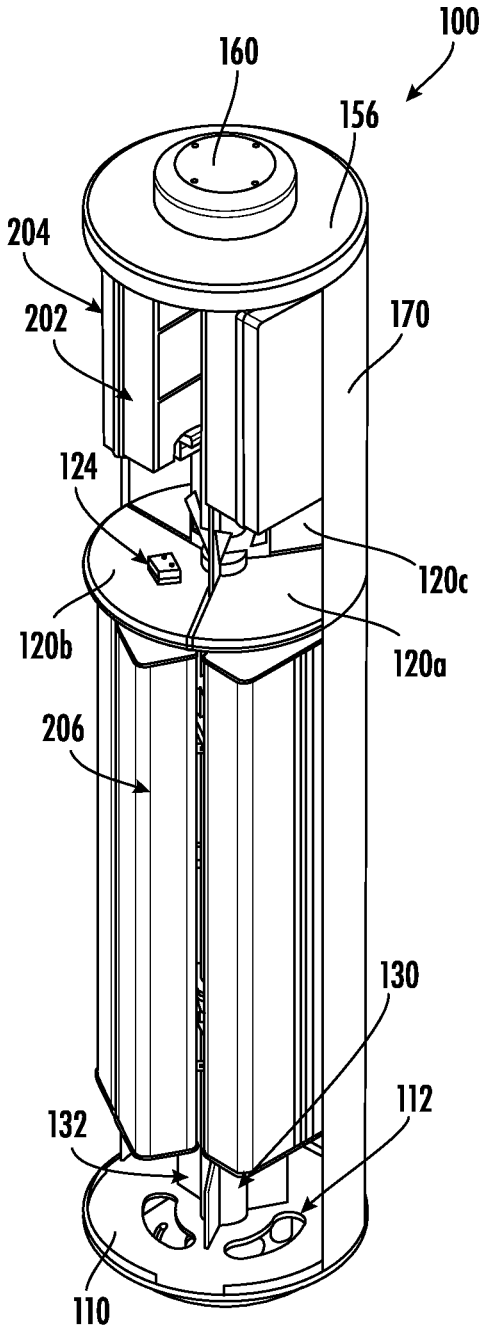
FIG. 2B is a schematic view of the antenna module of FIG. 2A.
Figure 3A:
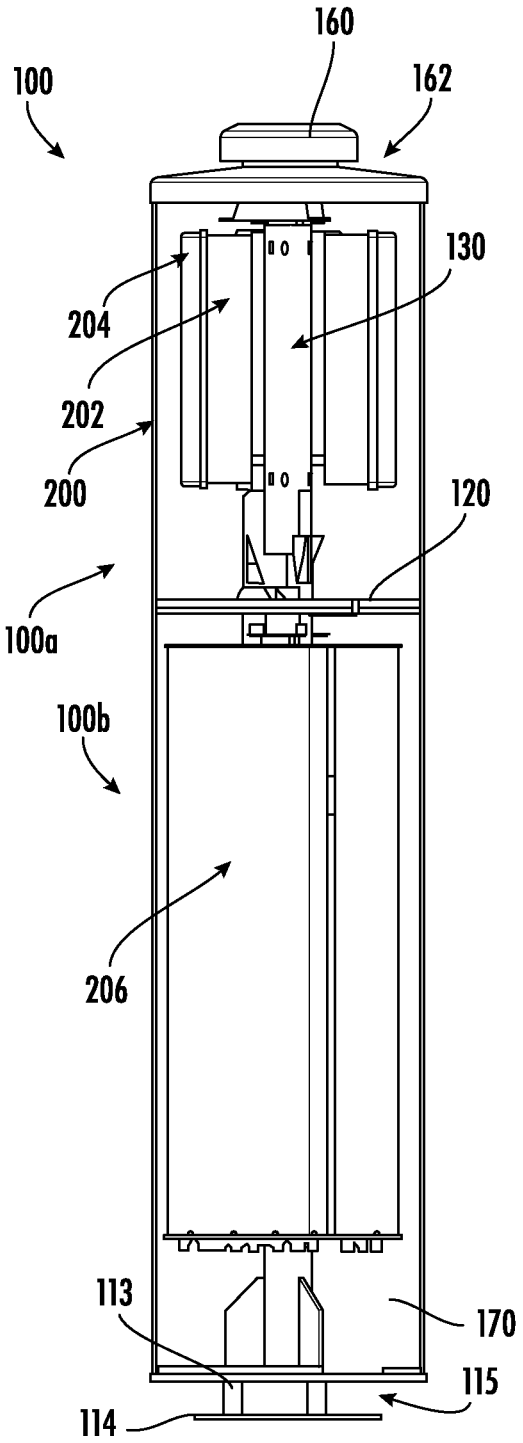
FIG. 3A is a front section view of the antenna module of FIGS. 2A-2B.
Figure 3B:
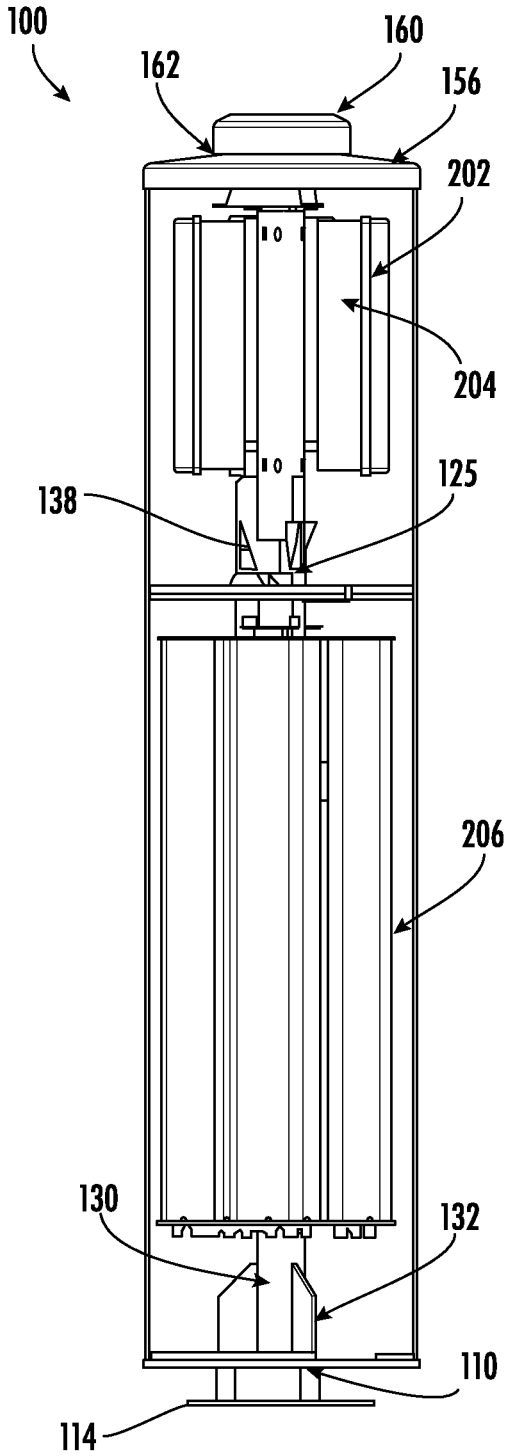
FIG. 3B is a schematic view of the antenna assembly of FIG. 3A.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown. Like numbers refer to like elements throughout and different embodiments of like elements can be designated using a different number of superscript indicator apostrophes (e.g., 10', 10", 10''').

In the figures, certain layers, components, or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Pursuant to embodiments of the present invention, antenna module arrangements for either Macro-cell or metrocell sites are provided. Antenna module assemblies are also provided herein. Related antenna module arrangements and assemblies are described in U.S. Provisional Application Ser. No. 63/008,408, filed Apr. 10, 2020, the disclosure of which is incorporated herein by reference it its entirety. Embodiments of the present invention will now be discussed in greater detail with reference to FIGS. 1-15B.

Referring now to the drawings, a telecommunications monopole designated at 10 is shown in FIG. 1. As can be seen in FIG. 1, the monopole 10, which is sized as a "metrocell" having a diameter of between about 8 inches to about 20 inches and a height of between about 20 feet and about 40 feet, is styled as a streetlight, with an arm 12 that mounts a luminaire 14 (such as an LED streetlight). The monopole 10 includes a radio module 15 and an antenna module 16. Monopoles of many varieties are known and are discussed in, for example, U.S. Patent Application Publication Ser. No. 15/913,019, filed Mar. 6, 2018; U.S. patent application Ser. No. 16/655,986, filed Oct. 17, 2019; and U.S. Provisional Patent Application Ser. No. 62/986,230, filed Jan. 31, 2020, the disclosures of each of which are incorporated herein by reference in their entireties. Concepts discussed herein are equally applicable to Macro-cell-sized monopoles, to multi-leg antenna towers, and to other deployment structures such as rooftops.

An antenna module for mounting on a monopole, designated broadly at 100, is shown in FIGS. 2A-4B. The antenna module 100 includes a foundation plate 114 and a bottom plate 110 that is separated from the foundation plate 114 by spacers 113 to form a gap 115. In some embodiments, the spacers 113 may have a height ($H_2$) in the range of about 3 inches to about 8 inches (see, e.g., FIG. 8B). As discussed in further detail below, the spacers 113 (and gap 115) are configured to lift the module 100 slightly above a top end of the monopole 10, which will help to allow air to flow into the antenna module 100. The foundation plate 114 includes discontinuous arcuate slots 116 in the form of a circle (FIG. 4A) for mounting atop the monopole 10, and a central hole 114*a* (see also, FIG. 9). The central hole 114*a* is sized such that cables may be routed from the monopole 10 to the antenna module 100 through the central hole 114*a*. The bottom plate 110 also has discontinuous arcuate slots 112 positioned generally above the foundation plate 114. The arcuate slots 112 are also sized such that the cables may be routed from the monopole 10 into the antenna module 100. For example, in some embodiments, cables (e.g., from remote radio units) may be routed from the monopole 10 through the central hole 114*a* of the foundation plate 114, then through the arcuate slots 112 of the bottom plate 110 to antenna-radio unit(s) 200 and/or antenna(s) 206 within the module 100. In some embodiments, the antenna module 100 may be sized and configured to be used on rooftop 20 deployments (see, e.g., FIG. 10). For example, in some embodiments, the foundation plate 114 may be configured to be mounted on a smaller monopole 10' or rooftop platform. In some embodiments, the antenna module 100 may be sized and configured to be mounted on other types of deployments such as tower deployments (e.g., telecommunication lattice towers, electricity towers, concrete poles and/or concrete towers, etc.).

The module 100 further includes one or more support poles 130*a*, 130*b* or other support member(s). In some embodiments, the support poles 130*a*, 130*b* are tubular (i.e., hollow) such that air may flow up through the poles 130*a*, 130*b*. In some embodiments, a first (or bottom) support pole 130*a* is mounted to the upper surface of the bottom plate 110 and extends upwardly therefrom (see, e.g., FIGS. 4A-4B). The bottom support pole 130*a* is mounted generally in the center on the bottom plate 110, with the discontinuous arcuate slots 112 positioned circumferentially around the support pole 130*a*. The bottom support pole 130*a* is open at both ends which will allow air to flow in through one end (e.g., through an opening in the bottom plate 110) and out the other end (e.g., into a top compartment 100*a* of the module 100). The bottom support pole 130*a* may be supported by gussets 132 (which may be coupled to the bottom plate 110 between each arcuate slot 112).

Figure 4A:
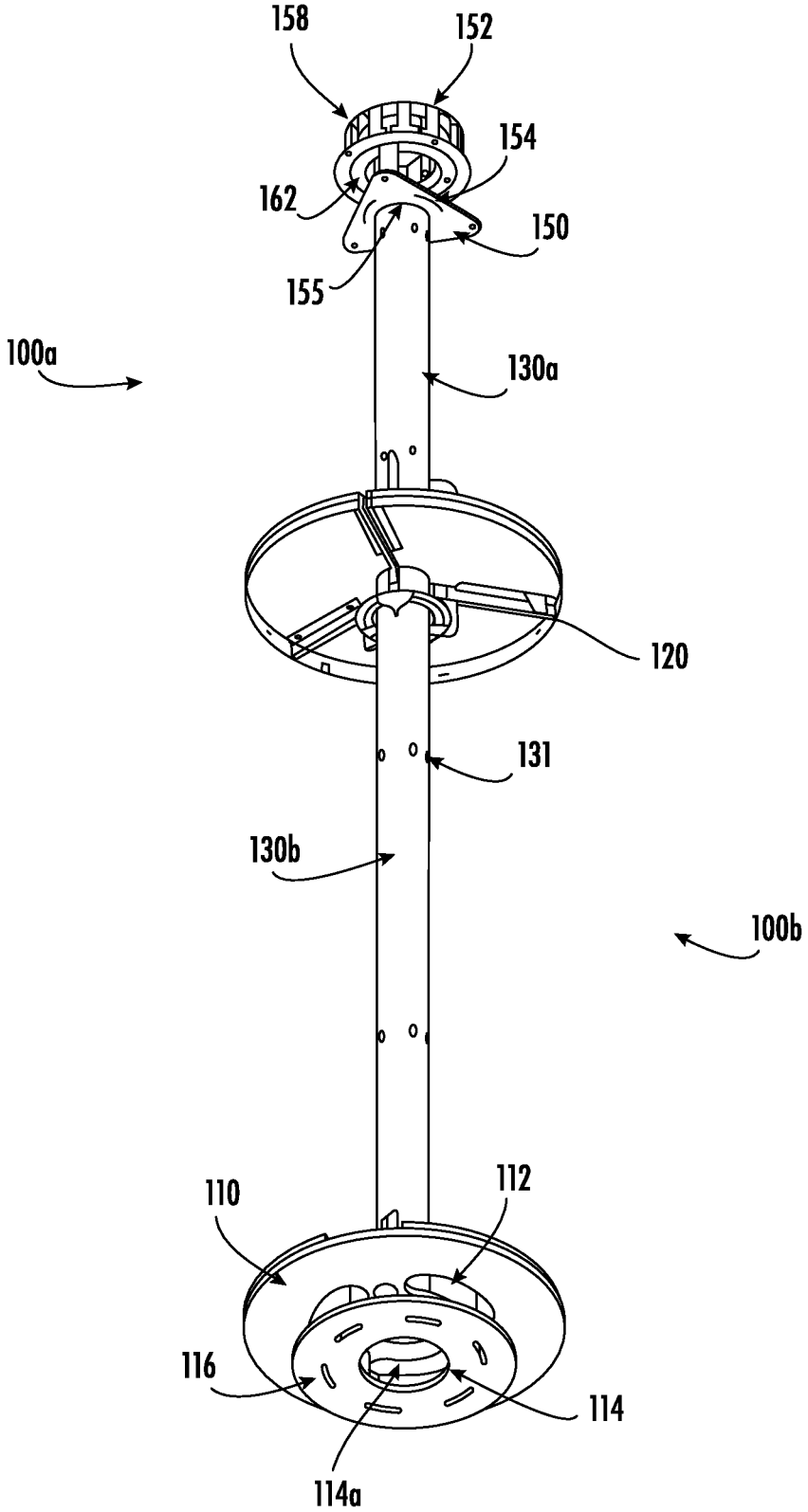
FIG. 4A is a bottom perspective view of the structural components of the antenna module of FIGS. 2A-3B according to embodiments of the present invention.
Figure 4B:
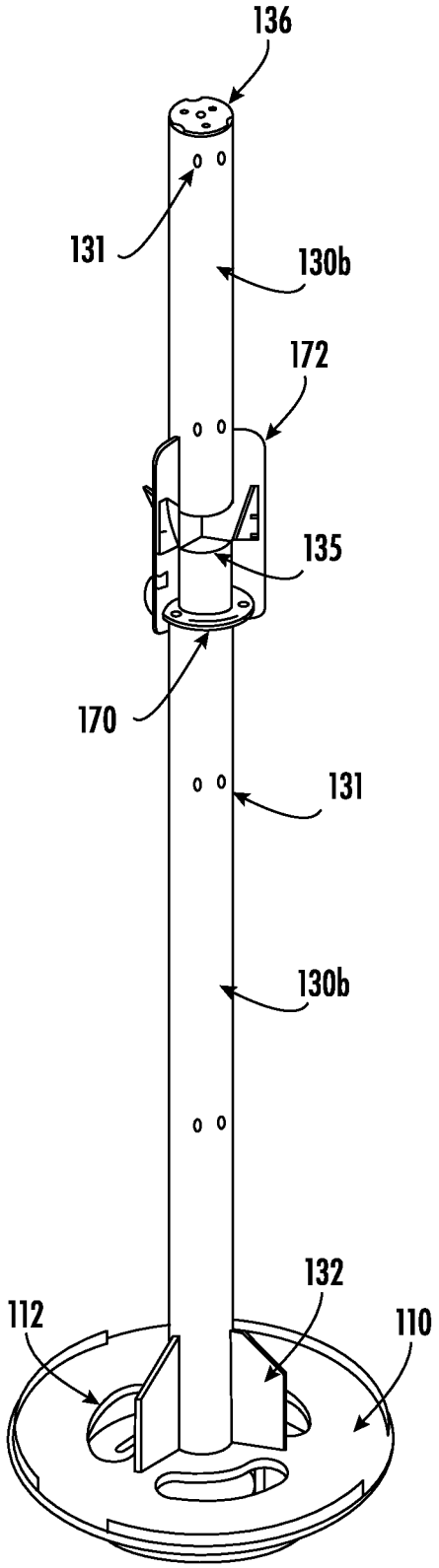
FIG. 4B is a top perspective view of the foundation plate, bottom plate, and support plate of the antenna module of FIGS. 2A-3B according to embodiments of the present invention.
Figure 5A:
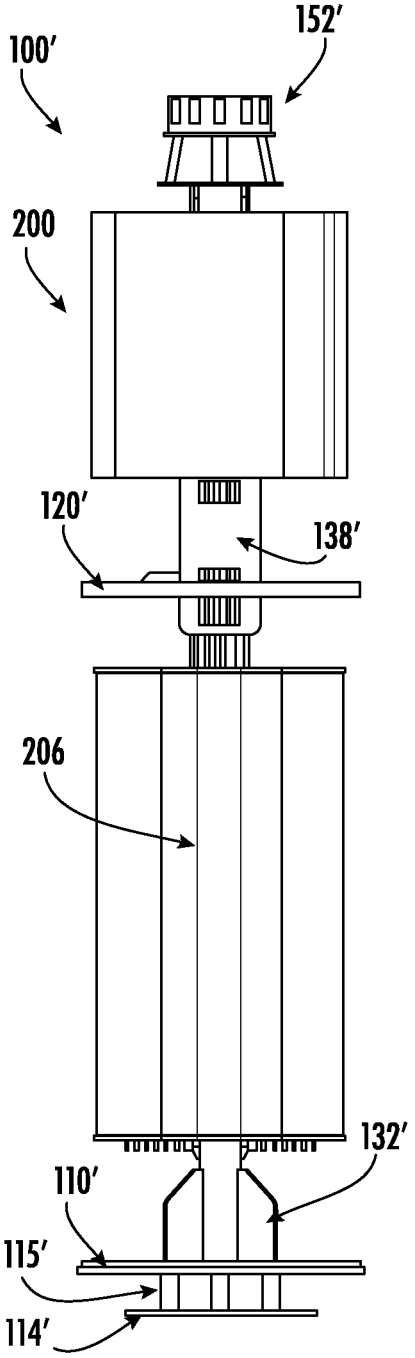
FIG. 5A is a front view of an antenna module having three active antennas according to embodiments of the present invention without a radome.
Figure 5B:
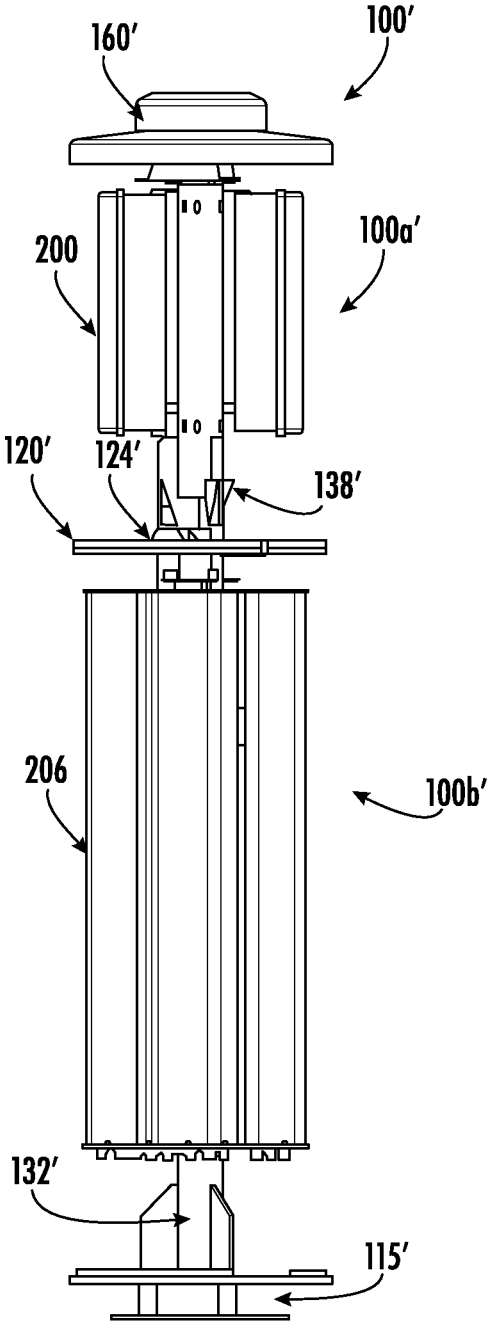
FIG. 5B is a schematic view of the antenna module of FIG. 5A.
Figure 6A:
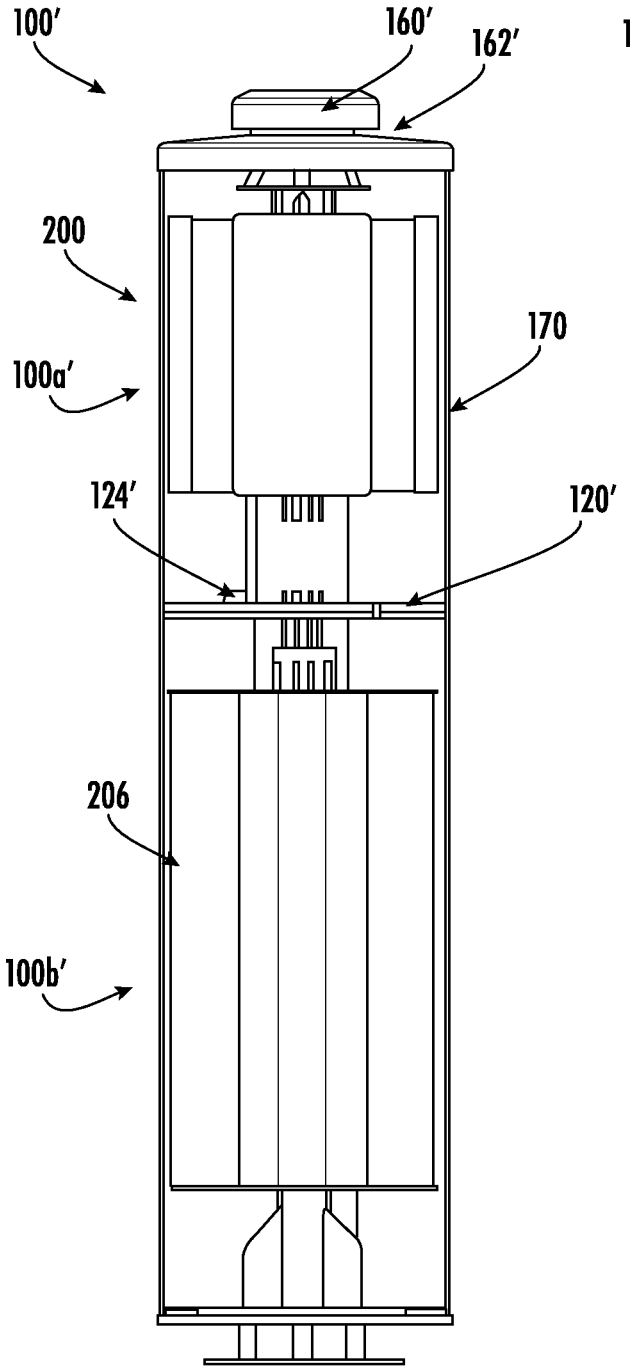
FIG. 6A is a front section view of the antenna module of FIGS. 5A-5B.
Figure 6B:
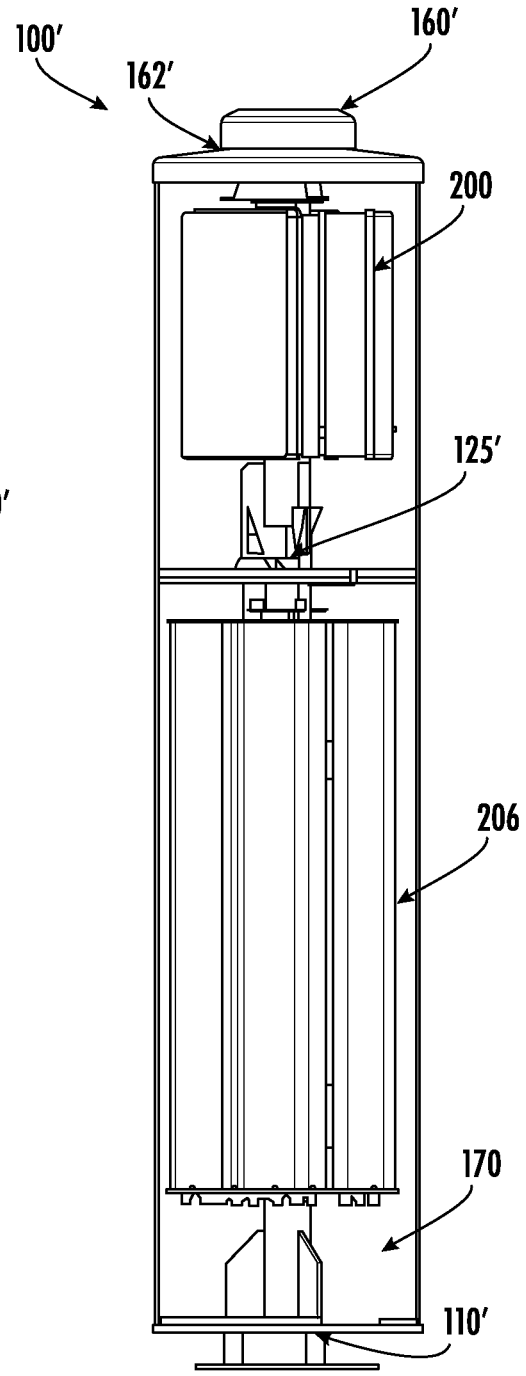
FIG. 6B is a schematic view of the antenna module of FIG. 6A.
Figure 7A:
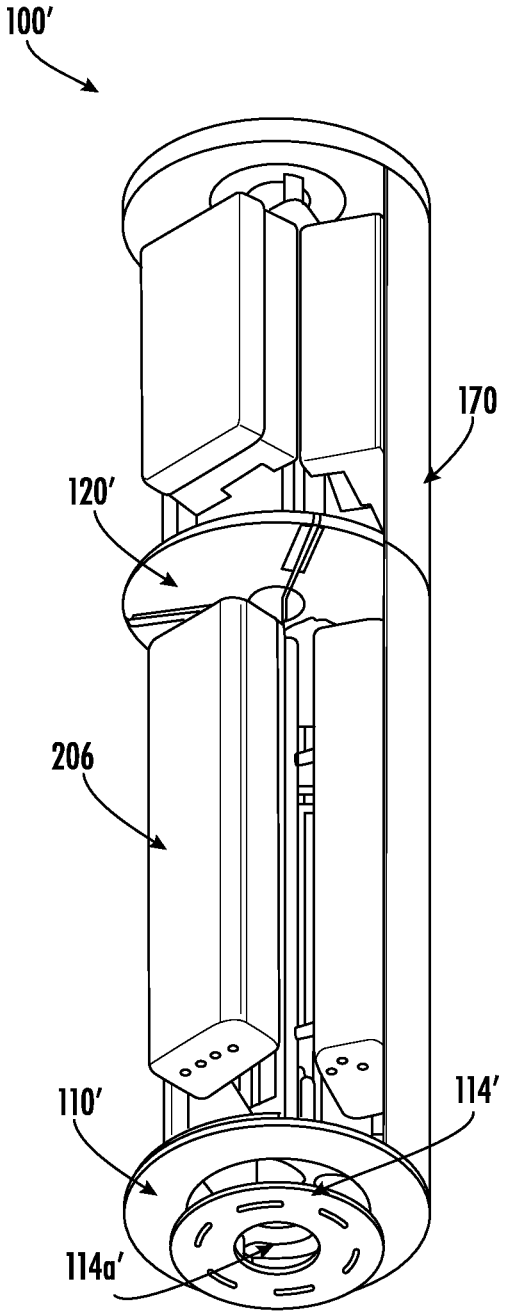
FIG. 7A is a front perspective cutaway view of the antenna module of FIGS. 6A-6B.
Figure 7B:
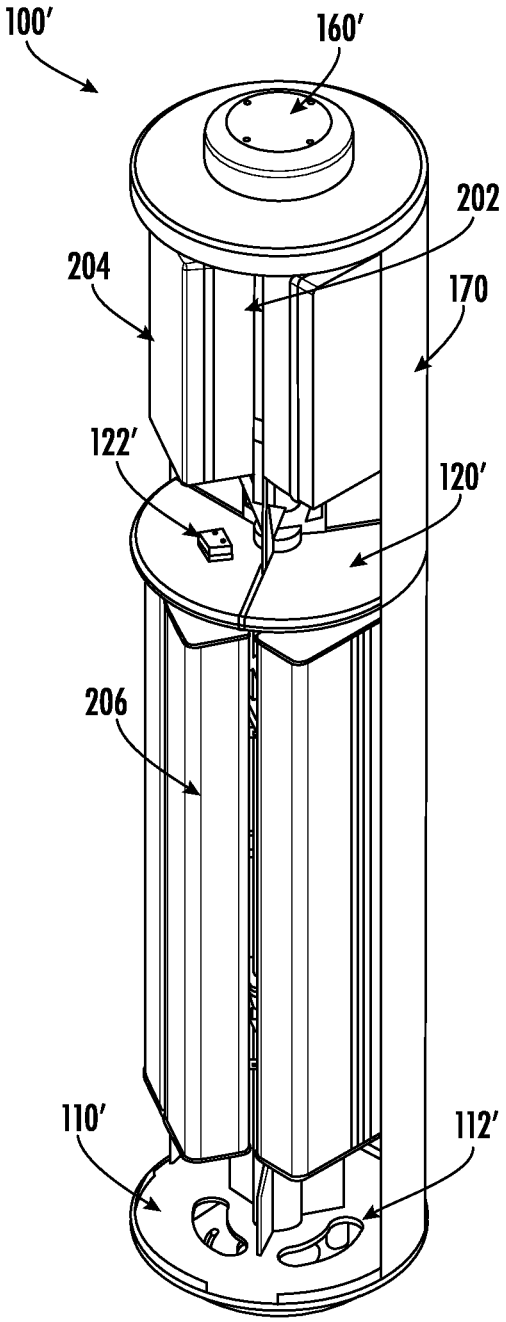
FIG. 7B is a schematic view of the antenna module of FIG. 6A.
Figure 8A:
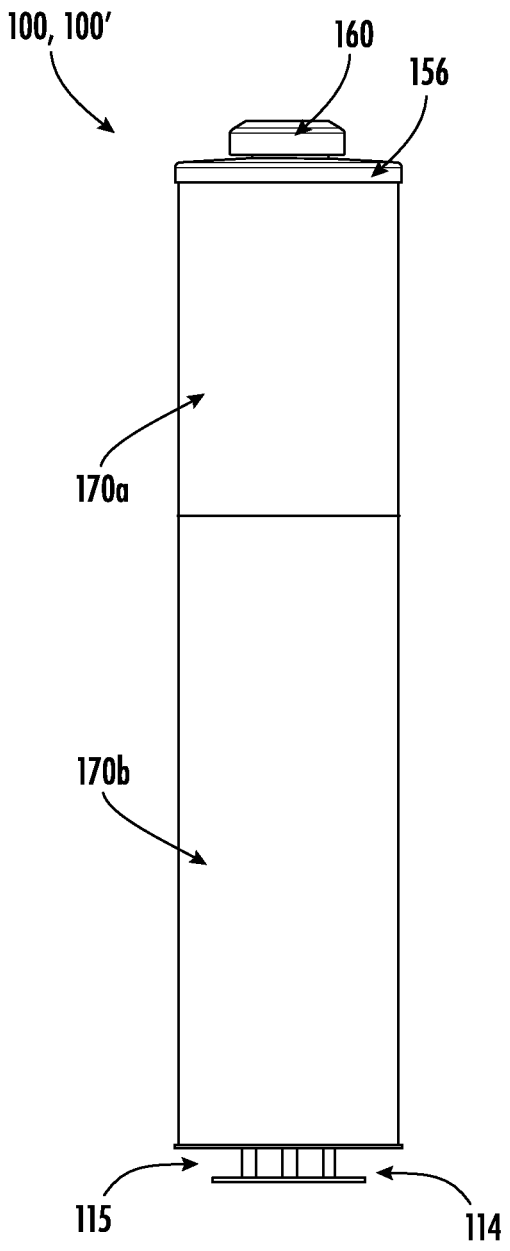
FIG. 8A is a front view of an antenna module according to embodiments of the present invention.
Figure 8B:
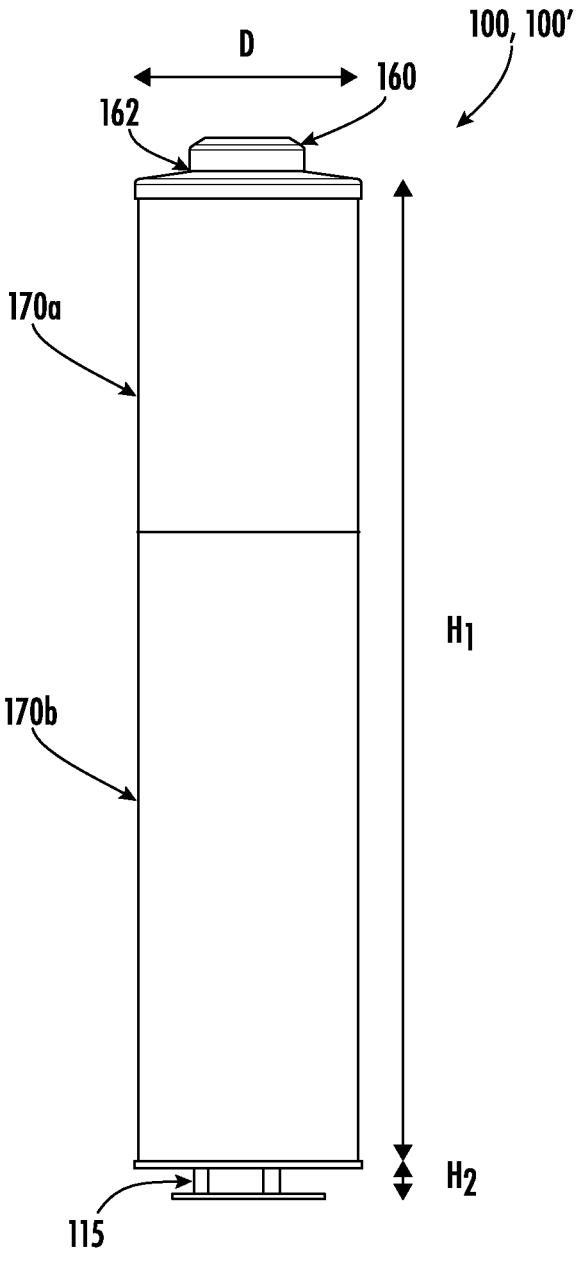
FIG. 8B is a schematic of the antenna module of FIG. 8A.
Figure 8C:
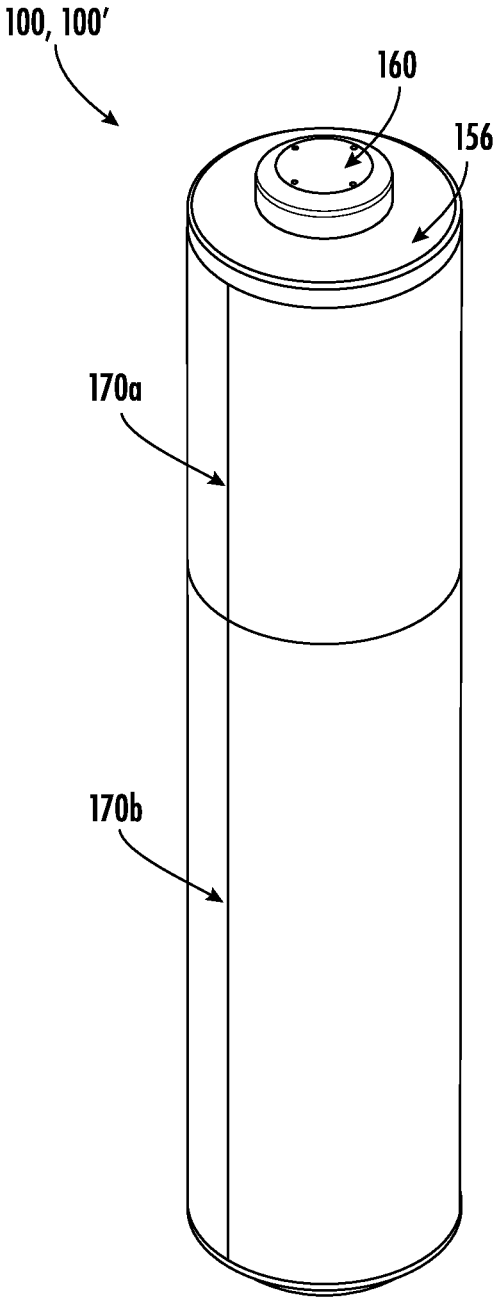
FIG. 8C is a front perspective view of the antenna module of FIGS. 8A-8B.
Figure 8D:
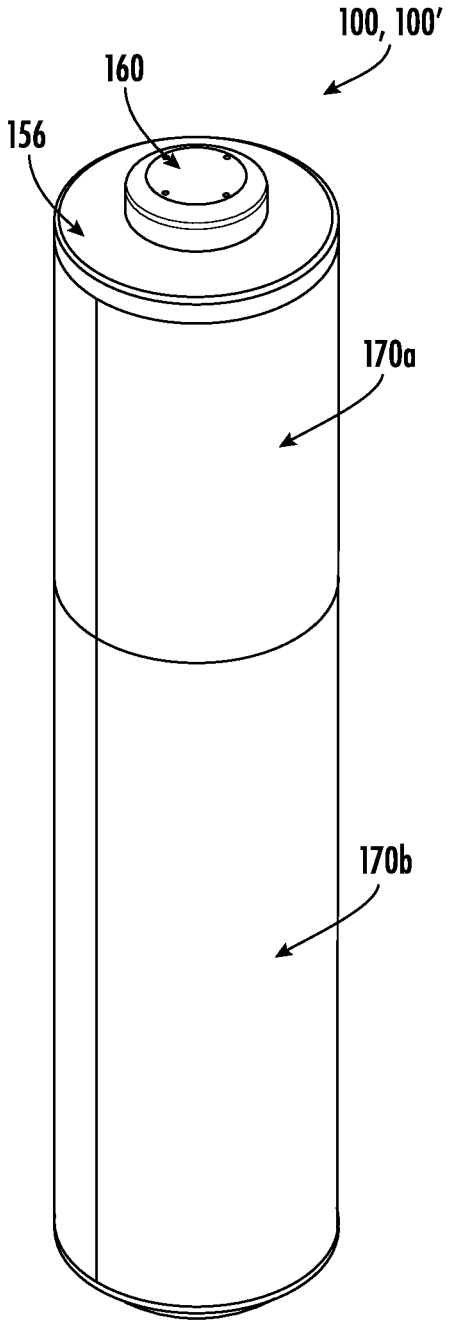
FIG. 8D is a schematic view of the antenna module of FIG. 8C.
Figure 9:
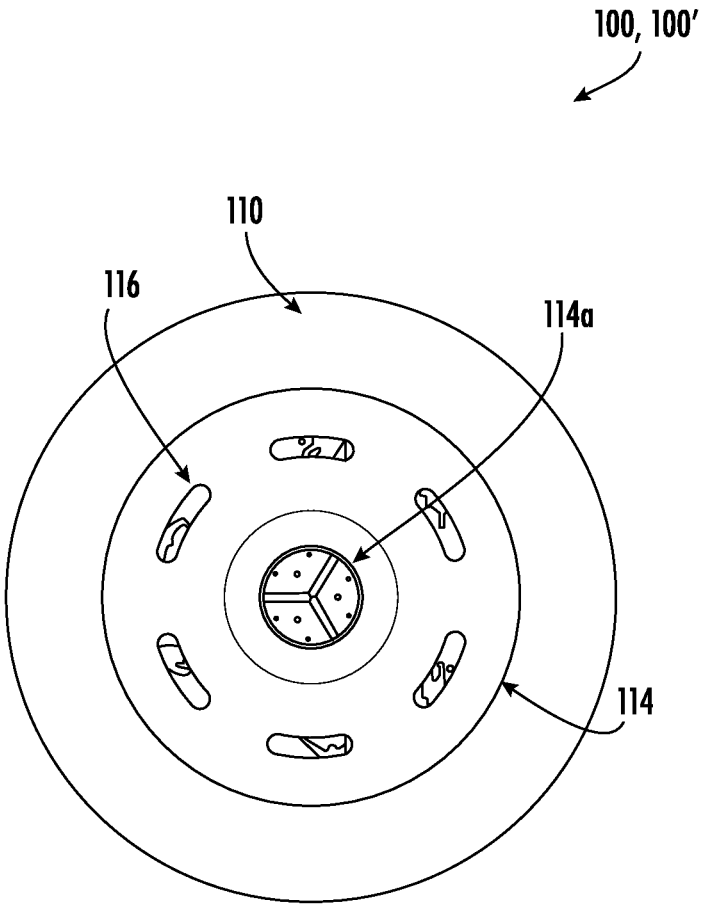
FIG. 9 is a bottom view of an antenna module according to embodiments of the present invention.

In some embodiments, the opposing end of the bottom support pole 130*a* may be secured to a second (top) support pole 130*b*. In some embodiments, the bottom and top support poles 130*a*, 130*b* may be secured together via crucifix plates 172. For example, as shown in FIG. 4B, the crucifix plates 172 may secure the first and second support poles 130*a*, 130*b* together such that a gap (or air inlet) 135 is formed between the support poles 130*a*, 130*b*. As discussed in further detail below, the gap 135 between the support poles 130*a*, 130*b* may allow air to flow from the bottom support pole 130*b* into a top compartment 100*a* of the antenna module 100.

In some embodiments, an upper plate 150 is mounted to the upper end of the second support pole 130*b* and extends radially outwardly therefrom. In some embodiments, the upper plate 150 may be secured to the top of the second support pole 130*b* via a weld plate 136. In some embodiments, the upper plate 150 may be triangular in shape (see, e.g., FIG. 4A). The upper plate 150 includes arcuate openings 154 and a central opening 155.

In some embodiments, the module 100 may include a single support pole 130 extending from the bottom plate 110 to the upper plate 150. In some embodiments, instead of a gap 135, the single hollow support pole 130 may comprise a plurality of holes (not shown) that may allow air to flow from the support pole 130 into the top compartment 100*a* (and/or bottom compartment 100*b*).

A divider plate 120 may be mounted to the support pole 130 (e.g., the bottom support pole 130*b*) between the bottom plate 110 and the upper plate 150. The divider plate 120 separates the antenna module 100 into top and bottom antenna/radio compartments 100*a*, 100*b*. In some embodiments, the divider plate 120 comprises a central opening 125 configured such that the support pole 130 may extend therethrough. The central opening 125 may also be sized and configured such that cables (not shown) may be routed between the top and bottom compartments 100*a*, 100*b*. In some embodiments, the divider plate 120 may comprise one or more plates 120*a-c* that surround the support pole 130 (see, e.g., FIG. 2B). A fan controller 124 (e.g., a temperature sensor) is mounted to the divider plate 120.

In some embodiments, the module 100 may further include additional gussets (or fins) 138 located above the divider plate 120. The gussets 138 may be coupled to the top support pole 130*a*, the crucifix plates 172, and/or the divider plate 120. When air exits the bottom support pole 130*b* into the top compartment 100*a* of the antenna module 100 (e.g., via the gap 135), the additional gussets 138 may help to direct the airflow and/or induce turbulent airflow within the top compartment 100*a*.

A fan unit 152 is mounted to the upper plate 150. A lower cap 156 is positioned above the upper plate 150. A motor 158 that drives the fan unit 152 extends above the lower cap 156 and is covered with an upper cap 160. The upper cap 160 is mounted such that a gap 162 is present between the upper and lower caps 156, 160. The fan unit 152 is electrically connected with the fan controller 124. As discussed in further detail below, the fan unit 152 is configured to draw air up through the top and bottom support poles 130*a*, 130*b*.

As shown in FIGS. 2A-2B and FIGS. 3A-3B, one or more antenna-radio units 200 are mounted to the top support pole 130*a* within the top antenna/radio compartment 100*a* of the module 100. The antenna-radio units 200 may be mounted to the support pole 130*a* via mounting brackets 170 and/or mounting apertures 131 (see also, e.g., FIGS. 4A-4B). The antenna-radio unit(s) 200 comprises both a transmit/receive radio 202 and an antenna 204 combined in the same unit (these are sometimes also known as "active" antennas). In some embodiments, the antenna module 100 comprises two or more antenna-radio units 200. For example, as shown in FIGS. 2A-3B, in some embodiments, the antenna module 100 may comprise two antenna-radio units 200. The active antennas 200 have 180 degrees of separation. In some embodiments, the antenna module 100 may comprise three antenna-radio units 200 (see, e.g., FIGS. 5A-7B).

The illustrated antenna-radio unit(s) 200 may be a "5G" unit, which is a device that meets the requisite high level of performance and precision to satisfy 5G protocols and performance requirements. Exemplary 5G antenna-radio units 200 include those offered by Ericsson, Samsung, and Nokia, and most OEM radios. The antenna-radio unit 200 also includes connectors (not visible herein) to provide an interface for power and signal cables, which can be routed to the antenna-radio unit(s) 200 from the interior of the monopole 10 through the central hole 114*a* in the foundation plate 114, through the arcuate slots 112 in the bottom plate 110, and through the central opening 125 in the divider plate 120.

As shown in FIGS. 2A-2B and FIGS. 3A-3B, one or more antennas 206 are mounted to the bottom support pole 130*b* within the bottom compartment 100*b* of the module 100. Similar to the antenna-radio units 200, the antennas 206 may be mounted to the support pole 130*b* via mounting brackets 170 and/or mounting apertures 131. In some embodiments, the antennas 206 are passive, and are connected with radio(s) (not shown) mounted elsewhere in the monopole 100 (for example, the unseen radio(s) may be mounted below the module 100 and connected via cables that are routed through the central hole 114*a* and the arcuate slots 112 into the module 100. In some embodiments, the antenna module 100 may comprise three passive antennas 206 having 120 degrees of separation.

In some embodiments, the location of the antenna-radio units 200 and antennas 206 may be reversed. For example, in some embodiments, the one or more antenna-radio units 200 (i.e., active antennas) may be mounted to the bottom support pole 130*b* within the bottom antenna/radio compartment 100*b* of the module 100 and the passive antennas 206 may be mounted to the top support pole 130*a* within the top antenna/radio compartment 100*a* of the module 100.

As shown in FIGS. 8A-8D, a shroud (or radome) 170 surrounds the module 100 between the bottom plate 110 and the lower cap 156. The shroud 170*a* may comprise a top section 170*a* and a bottom section 170*b* that surround the top and bottom compartments 100*a*, 100*b* of the module 100, respectively, or may comprise a single section that covers both compartments 100*a*, 100*b*. However, and notably, the top and bottom section of the shroud 170*a*, 170*b* do not extend downwardly to cover the foundation plate 114 or upwardly beyond the lower cap 156. Thus, the gaps 115, 162 remain open to the environment. By shielding/concealing the internal equipment of the module 100 from view, the shroud 170 serves to provide a more appealing aesthetic appearance to the module 100. In some embodiments, the shroud 170 has a diameter (D) that substantially matches that of the monopole 10. A typical diameter (D) for the shroud 170 may be between about 6 inches and about 14 inches. The antenna module 100 of the present invention may have a height ($H_1$) in the range of about 10 feet to about 20 feet. In some embodiments, the shroud 170 is formed of a polymeric material, for example, acrylonitrile butadiene styrene (ABS).

Because of the presence of the gaps 115, 162, operation of the fan unit 152 draws air through the gap 115 and the bottom plate 110 into the bottom support pole 130*b*. The air flows upwardly through the bottom support pole 130*b* exiting through the gap 135 into the top antenna/radio compartment 100*a*, thereby cooling the antenna-radio unit(s) 200 (which generates heat due to the operation of the radio(s) 202). When the cooling air reaches the upper plate 150, the air flows through the holes 154 and the lower cap 156 and is exhausted through the gap 162. Operation of the fan unit 152 is controlled by the fan controller 124, which can both activate/deactivate the fan unit 152 and, when activated, control its speed, typically based on the temperature within the shroud 170.

Referring now to FIGS. 5A-7B, another antenna module according to embodiments of the present invention, designated broadly at 100', is illustrated. Properties and/or features of the module 100' may be described above in reference to FIGS. 2A-4B and duplicate discussion thereof may be omitted herein for the purposes of discussing FIGS. 5A-7B. As can be seen from FIGS. 5A-7B, the antenna module 100' differs from module 100 in that the module 100' includes three antenna-radio units 200 (i.e., active antennas) in the top compartment 100*a'* of the module 100, compared to two antenna-radio units 200 in the top compartment 100*a* of module 100. Each antenna module 100, 100' includes three passive antennas 206 in the bottom compartment 100*b*, 100*b'* of the modules 100, 100'.

Each of the three antenna-radio units 200 is mounted to the top support pole 130*a'* via mounting brackets 170' and/or mounting apertures 131'. Cables are routed through the arcuate slots 112' and central opening 125' to connect with the antenna-radio units 200 in the manner described above. The three antenna-radio units 200 are mounted 120 degrees from each other, so that the module 100' can provide optimum coverage for wireless transmission. A shroud 170' provides concealment for the antenna-radio units 200 and antennas 206. A typical diameter for the shroud 170 may be between about 10 inches and about 20 inches.

Those skilled in this art will appreciate that the module 100' can provide the advantages discussed above in connection with the module 100, but for a three-sector antenna module.

Figure 10:
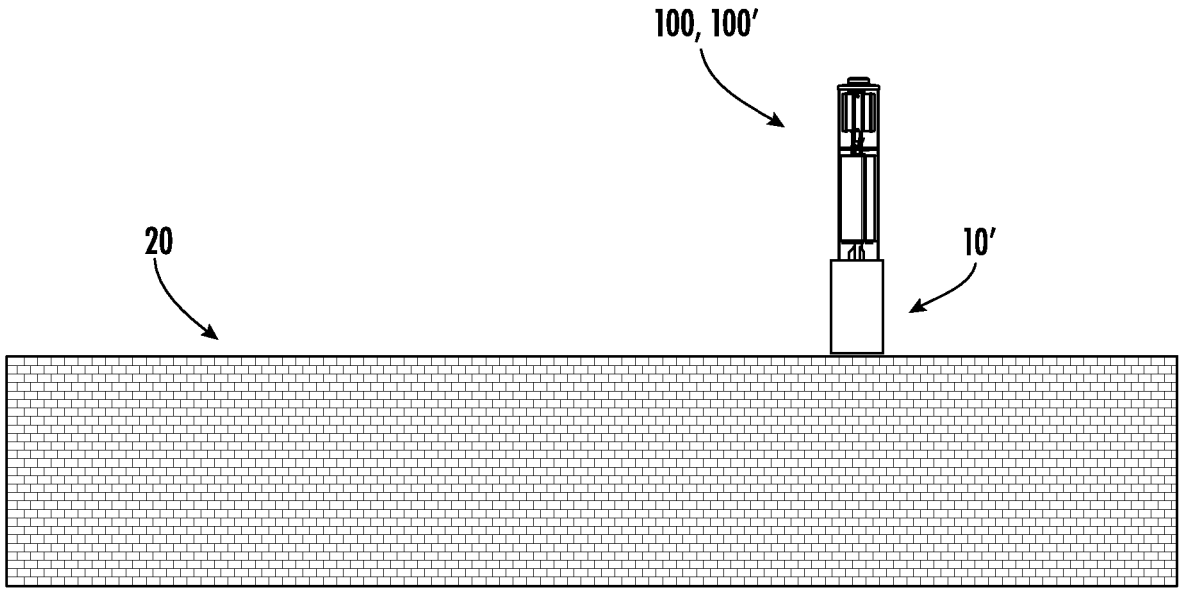
FIG. 10 is a front view of an antenna module of the present invention used in a rooftop deployment according to embodiments of the present invention.

In addition, it should be noted that, although the modules 100, 100' of the present invention are shown on a monopole 10, the modules 100, 100' may also be mounted on other structures, such as multi-leg antenna towers, rooftops (either on platforms or small poles), building walls, and the like (see, e.g., FIG. 10).

The antenna modules 100, 100' as described herein can enable easier zoning and planning permits, especially on crowded sites, while offering an upgrade path to overlay 5G services. This concealment solution offers a combined passive/active antenna platform for greater capacity, seamless introduction of 5G services while supporting a wide spectrum of legacy solutions and technologies (e.g., 2G/3G/4G technologies). It features an overall structure that can be factory integrated and tested, ready to deploy on site with minimal or reduced need for skilled labor. The solution can enable mobile network operators (MNOs) to deploy 5G services at an economical scale and can allow the swap and modernization of legacy and aged 4G-only solutions with easier zoning. With the antenna modules 100, 100' of the present invention, MNOs can achieve their deployment targets using existing (and new sites), fewer sites, and be fast to market. The solution is field upgradable allowing the introduction of new active antenna elements in the future, thereby eliminating costly and time consuming antenna swaps. The antenna modules 100, 100' of the present invention can offer an improved overall structure diameter (e.g., by at least 25%), allow for future upgrades for the first and second antenna, provide an OEM radio agnostic solution, and can improve overall thermal management of the antenna-radio units 200.

Referring now to FIGS. 11A-15B, an antenna module assembly 300 according to embodiments of the present invention is illustrated. Properties and/or features of the antenna module assembly 300 (and/or individual antenna modules 300*a*, 300*b* of assembly 300) may be described above in reference to the antenna modules 100, 100' shown in FIGS. 2A-7B and duplicate discussion thereof may be omitted herein for the purposes of discussing FIGS. 11A-15B.

As shown in FIGS. 11A-14D, in some embodiments, the antenna module assembly 300 may include an active antenna module 300*a* and a passive antenna module 300*b*. As described in further detail below, in some embodiments, the active and passive antenna modules 300*a*, 300*b* may be modular, meaning that the modules 300*a*, 300*b* may be mounted on a monopole 10 or other structure and utilized separately as individual units (see, e.g., FIGS. 11A-12E) or, in some embodiments, the active antenna module 300*a* may be combined with (e.g., stacked on top of) the passive antenna module 300*b* as an antenna module assembly 300 (see, e.g., FIGS. 13A-13B and FIGS. 14A-14D).

Figure 11A:
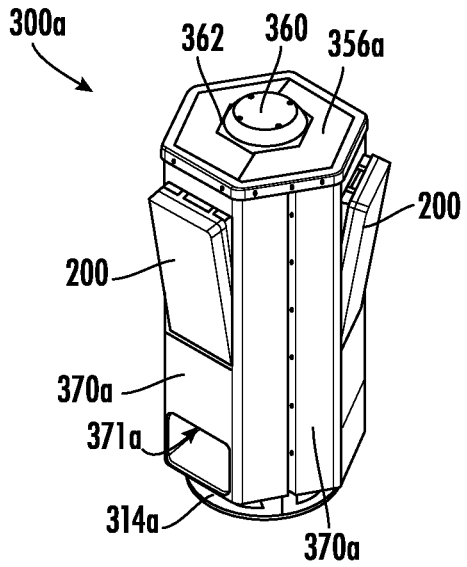
FIG. 11A is a perspective view of an active antenna module according to embodiments of the present invention.
Figure 11B:
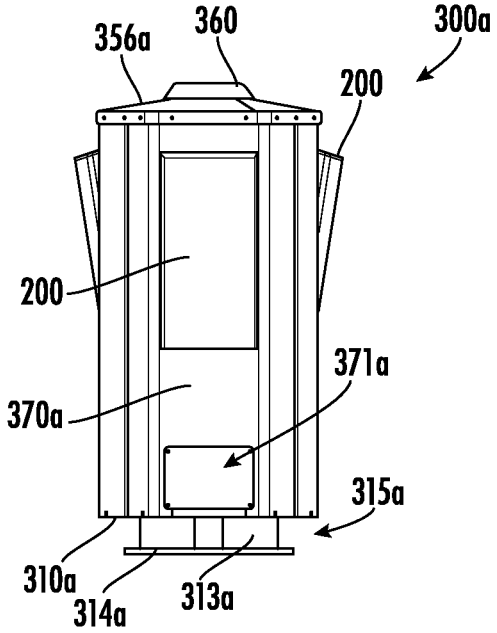
FIG. 11B is a side view of the active antenna module of FIG. 11A.
Figure 11C:
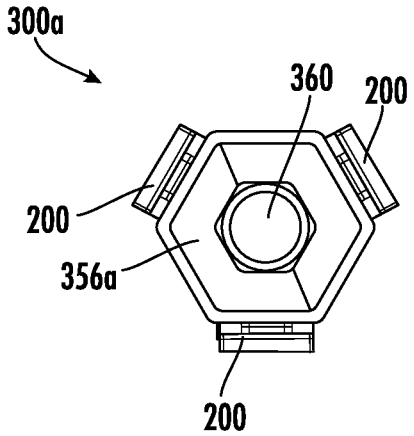
FIG. 11C is a top view of the active antenna module of FIG. 11A.
Figure 11D:
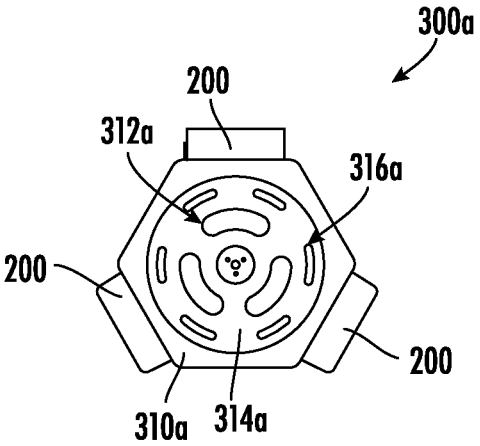
FIG. 11D is a bottom review of the active antenna module of FIG. 11A.
Figure 11E:
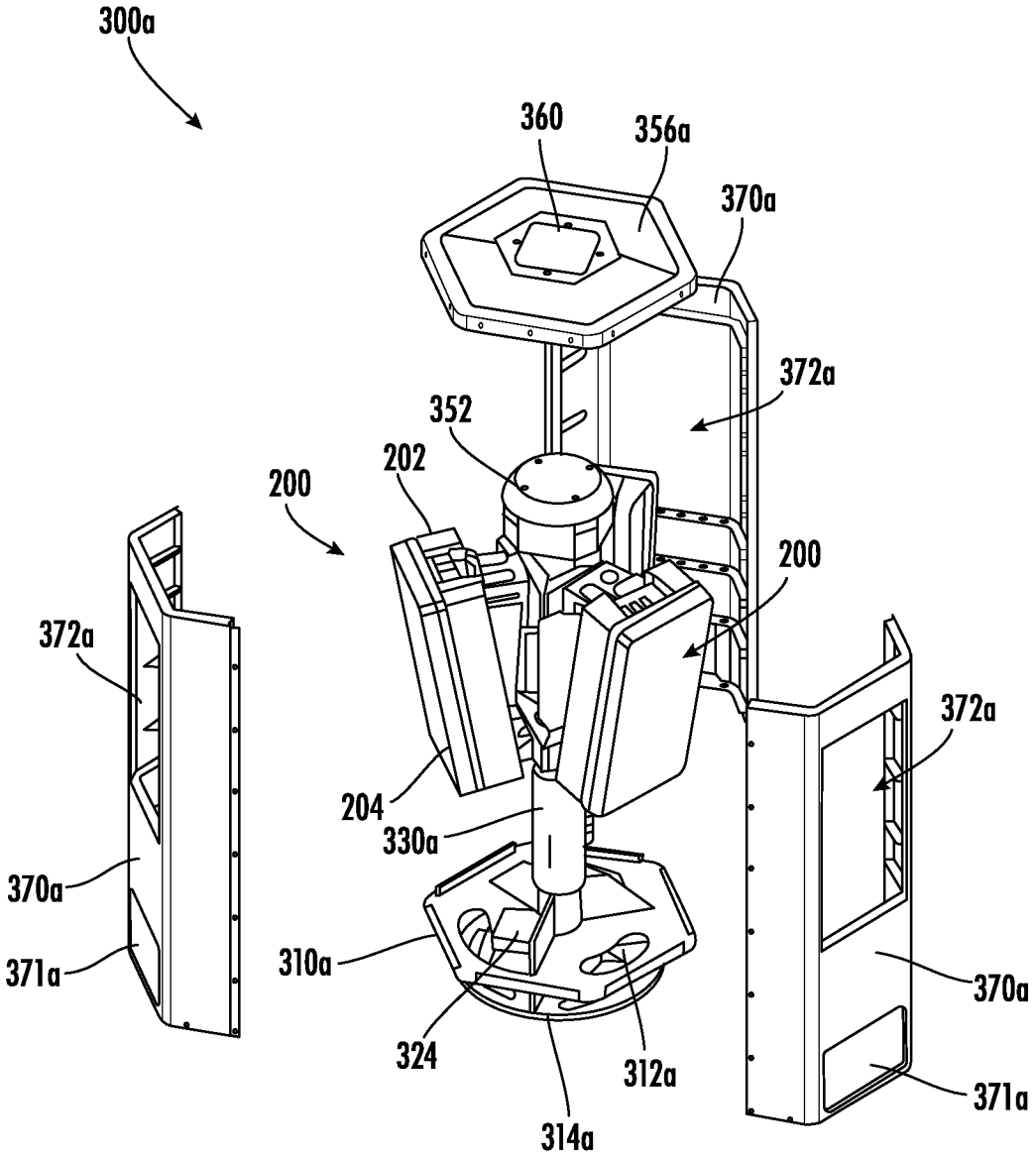
FIG. 11E is an exploded view of the active antenna module of FIG. 11A.

Referring to FIGS. 11A-11E, the active antenna module 300*a* according to embodiments of the present invention is illustrated. The active antenna module 300*a* includes a foundation plate 314*a* and a bottom plate 310*a* that is separated from the foundation plate 314*a* by spacers 313*a* to form a gap 315*a*. As discussed in further detail below, the spacers 313*a* (and gap 315*a*) are configured to lift the module 300*a* slightly above a top end of the monopole 10 (e.g., when used an individual unit), which will help to allow air to flow into the antenna module 300*a*. In some embodiments, the foundation plate 314*a* and spacers 313*a* may be removably attached to the bottom plate 310*a* such that the active antenna module 300*a* may be combined with (stacked on top of) a passive antenna module 300*b* (see, e.g., FIGS. 14A-14D). The foundation plate 314*a* includes discontinuous arcuate slots 316*a* in the form of a circle (FIG. 11D) for mounting atop the monopole 10. The foundation plate 314*a* also includes discontinuous arcuate slots 312*a* sized such that cables may be routed from the monopole 10 into the active antenna module 300*a*. Located generally above the foundation plate 314*a*, the bottom plate 310*a* also has corresponding discontinuous arcuate slots 312*a* sized such that cables may be routed through into the active antenna module 300*a*. For example, in some embodiments, cables may be routed from the monopole 10 through the slots 312*a* of the foundation plate 314*a*, then through the arcuate slots 312*a* of the bottom plate 310*a* to antenna-radio unit(s) 200 within the active antenna module 300*a*. When in a stacked relationship with the passive antenna module 300*b*, the slots 312*a* in the bottom plate 310*a* for the active antenna module 300*a* also allow cables to be routed from the passive antenna module 300*b* into the active antenna module 300*a*. As shown in FIGS. 11D-11E, in some embodiments, the bottom plate 310*a* may be hexagonal in shape.

In some embodiments, the active antenna module 300*a* may be sized and configured to be used on rooftop 20 deployments (see, e.g., FIG. 10). For example, in some embodiments, the foundation plate 314*a* may be configured to be mounted on a smaller monopole 10' or rooftop platform. In some embodiments, the active antenna module 300*a* may be sized and configured to be mounted on other types of deployments such as tower deployments (e.g., telecommunication lattice towers, electricity towers, concrete poles and/or concrete towers, etc.). As discussed, in some embodiments, the active antenna module 300*a* may be configured to be stacked on top of (combined with) a passive antenna module 300*b* (see, e.g., FIGS. 14A-14D).

As shown in FIG. 11E, the active antenna module 300*a* further includes a support pole 330*a* or other support member(s). In some embodiments, the support pole 330*a* is tubular (i.e., hollow) such that air may flow up through the pole 330*a*. In some embodiments, the support pole 330*a* is mounted to the upper surface of the bottom plate 310*a* and extends upwardly therefrom (see, e.g., FIG. 11E). The support pole 330*a* is mounted generally in the center on the bottom plate 310*a*, with the discontinuous arcuate slots 312*a* positioned circumferentially around the support pole 330*a*. The support pole 330*a* is open at both ends which will allow air to flow in through one end (e.g., through an opening in the bottom plate 310*a*) and out the other end (e.g., through fan unit 352). In some embodiments, the hollow support pole 330*a* may comprise a plurality of holes (not shown) that may allow air to flow from the support pole 330*a* into the active antenna module 300*a*.

A fan controller 324 (e.g., a temperature sensor) is mounted to the bottom plate 310*a*. A fan unit 352 is mounted to the top of the support pole 330*a*. A lower cap 356*a* is positioned above the fan unit 352. An upper cap 360 is mounted such that a gap 362 is present between the upper and lower caps 360, 356*a*. The fan unit 352 is electrically connected with the fan controller 324. Similar to the antenna modules 100, 100' described herein, the fan unit 352 is configured to draw air up through the support pole 330*a* and bottom plate 310*a* to cool the interior of the active antenna module 300*a*.

Because of the presence of the gaps 315*a*, 362, operation of the fan unit 352 draws air through the gap 315*a* and the bottom plate 310*a* into the support pole 330*a*. The air flows upwardly through the support pole 330*a* and slots 312*a* of the bottom plate 310*a* exiting through holes in the support pole 330*a* and bottom plate 310*a* into the active antenna module 300*a*, thereby cooling the antenna-radio unit(s) 200 (which generates heat due to the operation of the radio(s) 202). When the cooling air reaches the lower cap 356*a*, the air is exhausted through the gap 362. Operation of the fan unit 352 is controlled by the fan controller 324, which can both activate/deactivate the fan unit 352 and, when activated, control its speed, typically based on the temperature within the active antenna module 300*a*.

As shown in FIGS. 11A-11E, one or more antenna-radio units 200, as described herein, are mounted to the support pole 330*a* within the active antenna module 300*a*. The antenna-radio units 200 (which are typically "4G" and/or "5G" units) may be mounted to the support pole 330*a* via mounting brackets 400, described in further detail below (see, e.g., FIGS. 15A-15B). In some embodiments, the active antenna module 300*a* comprises two or more antenna-radio units 200. For example, as shown in FIGS. 11A-11E, in some embodiments, the active antenna module 300*a* may comprise three antenna-radio units 200. The active antennas 200 have 120 degrees of separation. As discussed below, in some embodiments, active antenna module 300*a* may allow for the active element (AAU) 204 of the antenna-radio unit 200 to be down-tilted (via mounting bracket 400).

In some embodiments, one or more shroud members (or radomes) 370*a* surround the active antenna module 300*a* between the bottom plate 310*a* and the lower cap 356*a*. As shown in FIG. 11E, the active antenna module 300*a* has three shroud members 370*a* (each shroud member 370*a* corresponding to an antenna-radio unit 200). However, and notably, the shroud members 370*a* do not extend downwardly to cover the foundation plate 314*a* or upwardly beyond the lower cap 356*a*. Thus, the gaps 315*a*, 362 remain open to the environment. By shielding/concealing the internal equipment of the active antenna module 300*a* from view, the shroud members 370*a* serve to provide a more appealing aesthetic appearance to the active antenna module 300*a* (particularly when the wall of each shroud member 370*a* is substantially flush with the front surface of the antenna-radio unit 200). In some embodiments, the shroud members 370*a* are formed of a polymeric material, for example, acrylonitrile butadiene styrene (ABS).

In some embodiments, each shroud member 370*a* is configured such that, when placed on the active antenna module 300*a*, the exterior shape of the active antenna module 300*a* is hexagonal. In some embodiments, each shroud member 370*a* may comprise a removable hatch 371*a* that allows access into the interior of the active antenna module 300*a* (e.g., to allow a technician to connect cables to the antenna-radio units 200).

In some embodiments, each shroud member 370*a* comprises a cut-out portion 372*a* (or "window"). Each cut-out portion 372*a* is sized and configured such that at least a portion of the antenna-radio unit 200 may extend through the respective shroud member 370*a*. In some embodiments, a grommet or sealant may be used to seal and/or fill any gaps between the edges of the cut-out portion(s) 372*a* and the antenna-radio unit(s) 200, thereby preventing any moisture (e.g., rain) from entering the active antenna module 300*a*. The cut-out portions 372*a* in the shroud members 370*a* may help to improve the overall RF performance of the antenna-radio units 200 by mitigating undesired impact on antenna gains and RF signal distortion, especially when dealing with a wideband spectrum.

Figure 15A:
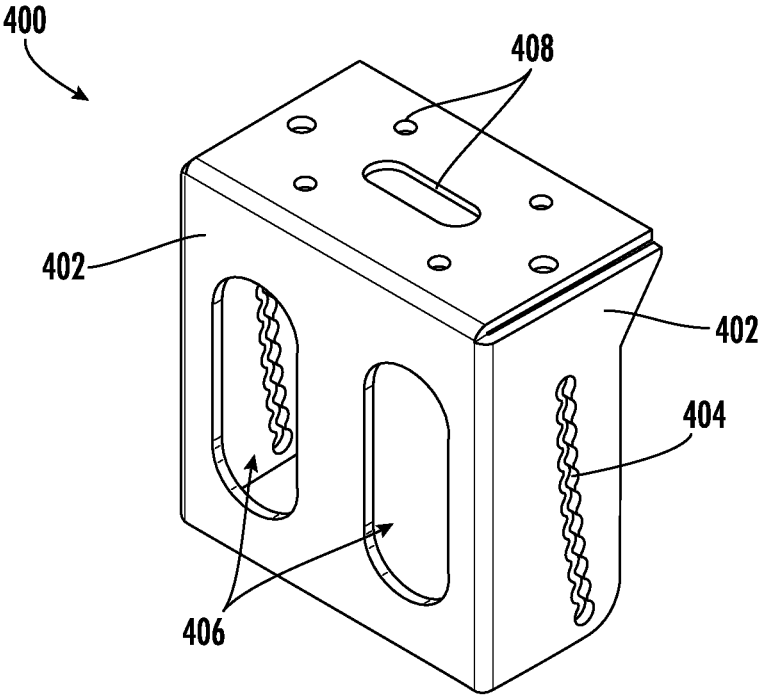
FIG. 15A is a perspective view of an exemplary tilt mount that may be used for an active antenna secured within the active antenna module.
Figure 15B:
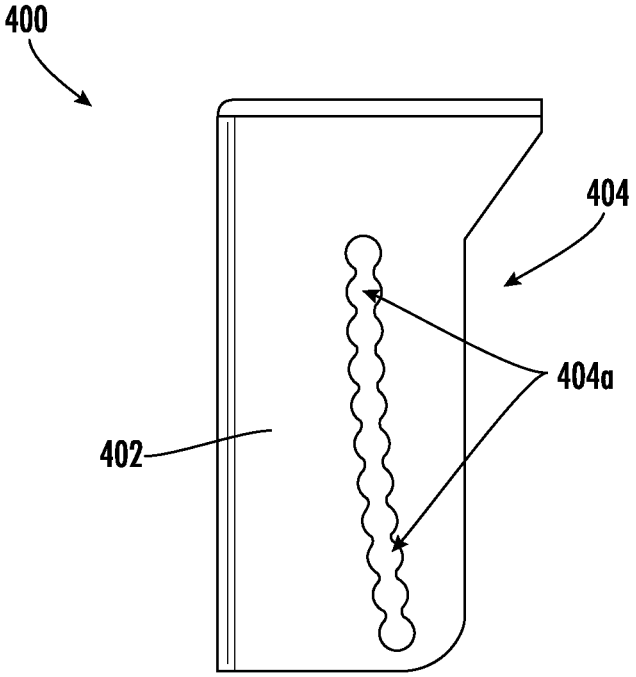
FIG. 15B is a side view of the tilt mount of FIG. 15A.

As shown in FIGS. 11A-11B and FIG. 11E, in some embodiments, the cut-out portions 372*a* may also allow the introduction of a down-tilt feature for the antenna-radio units 200. For example, in some embodiments, the antenna-radio units 200 may be configured to be tilted between about 0 degrees to about 15 degrees, such that the upper portion of the antenna-radio 200 extends radially outwardly through the window 372*a*. An exemplary mount 400 that may allow for the down-tilt of the antenna-radio unit 200 is illustrated in FIGS. 15A-15B. The mount 400 is configured to secure the antenna-radio unit(s) 200 to the support pole 330*a*. As shown in FIGS. 15A-15B, opposing sides 402 of the mount 400 may have a tilt adjustment mechanism 404. In some embodiments, the tilt adjustment mechanism 404 may comprise a series of holes (or notches) 404*a* that are configured such that the antenna-radio unit(s) 200 may be tilted in 1 degree increments. The sealant or grommet mentioned above may be configured such that the seal with the antenna-radio unit 200 remains even when the antenna-radio unit 200 is tilted.

Referring now to FIGS. 12A-12E, the passive antenna module 300*b* according to embodiments of the present invention is illustrated. As shown in FIGS. 12A-12B, FIG. 12E and FIGS. 13A-14D, one or more antennas 206 may be mounted to a support pole 330*b* within the passive antenna module 300*b*. In some embodiments, the antennas 206 are passive, and are connected with radio(s) (not shown) mounted elsewhere in the monopole 100 (for example, the unseen radio(s) may be mounted below the passive antenna module 300*b* and connected via cables that are routed through arcuate slots 312*b* in a bottom plate 310*b* and into the passive antenna module 300*b*. In some embodiments, the antennas 206 may be a "wide-band unit" (i.e., 2G/3G/4G unit). In some embodiments, the passive antenna module 300*b* may comprise three passive antennas 206 having 120 degrees of separation. Similar to the active antenna module 300*a* described herein, in some embodiments, passive antenna module 300*b* may allow for the passive antennas 206 to be down-tilted. A similar mount 400 used to mount the antenna-radio units 200 may also be used to mount the passive antennas 206 such that the passive antennas 206 may be down-tilted (see, e.g., FIGS. 15A-15B).

Figure 12A:
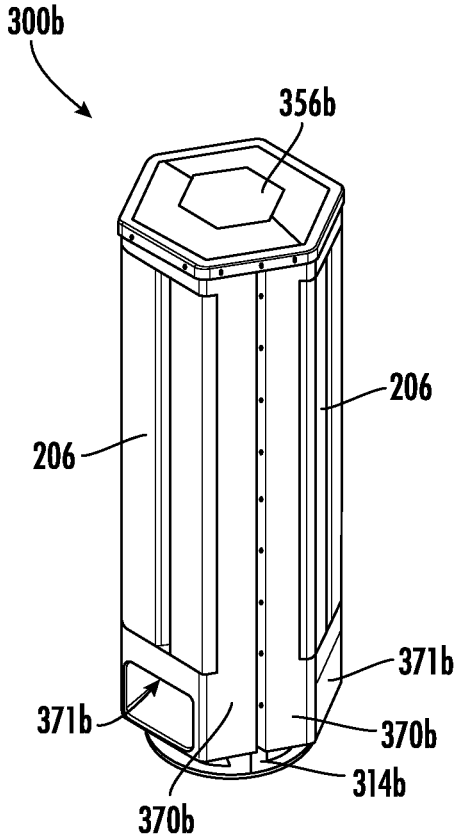
FIG. 12A is a perspective view of a passive antenna module according to embodiments of the present invention.
Figure 12B:
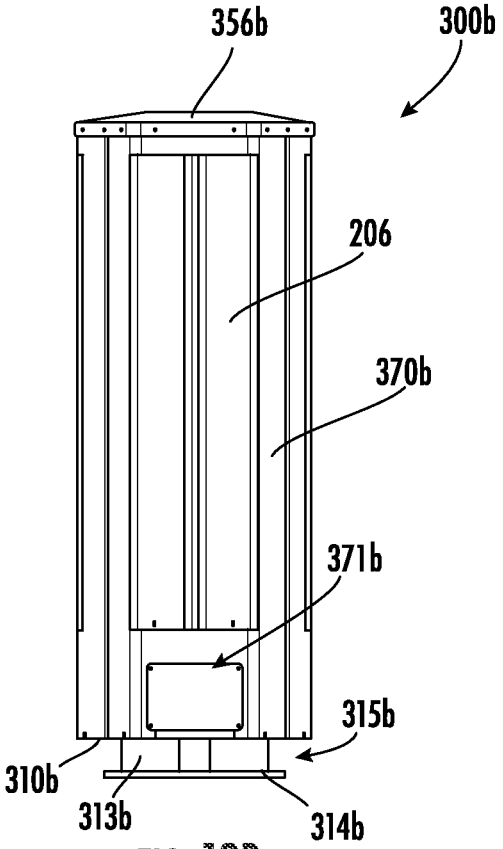
FIG. 12B is a side view of the passive antenna module of FIG. 12A.
Figure 12C:
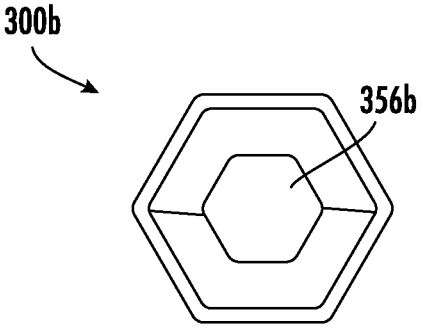
FIG. 12C is a top view of the passive antenna module of FIG. 12A.
Figure 12D:
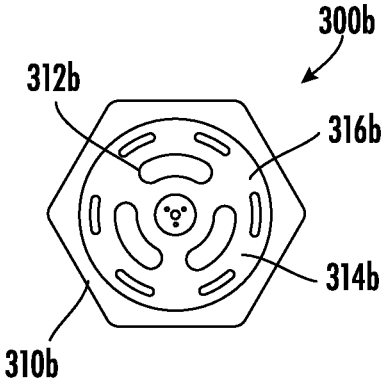
FIG. 12D is a bottom view of the passive antenna module of FIG. 12A.
Figure 12E:
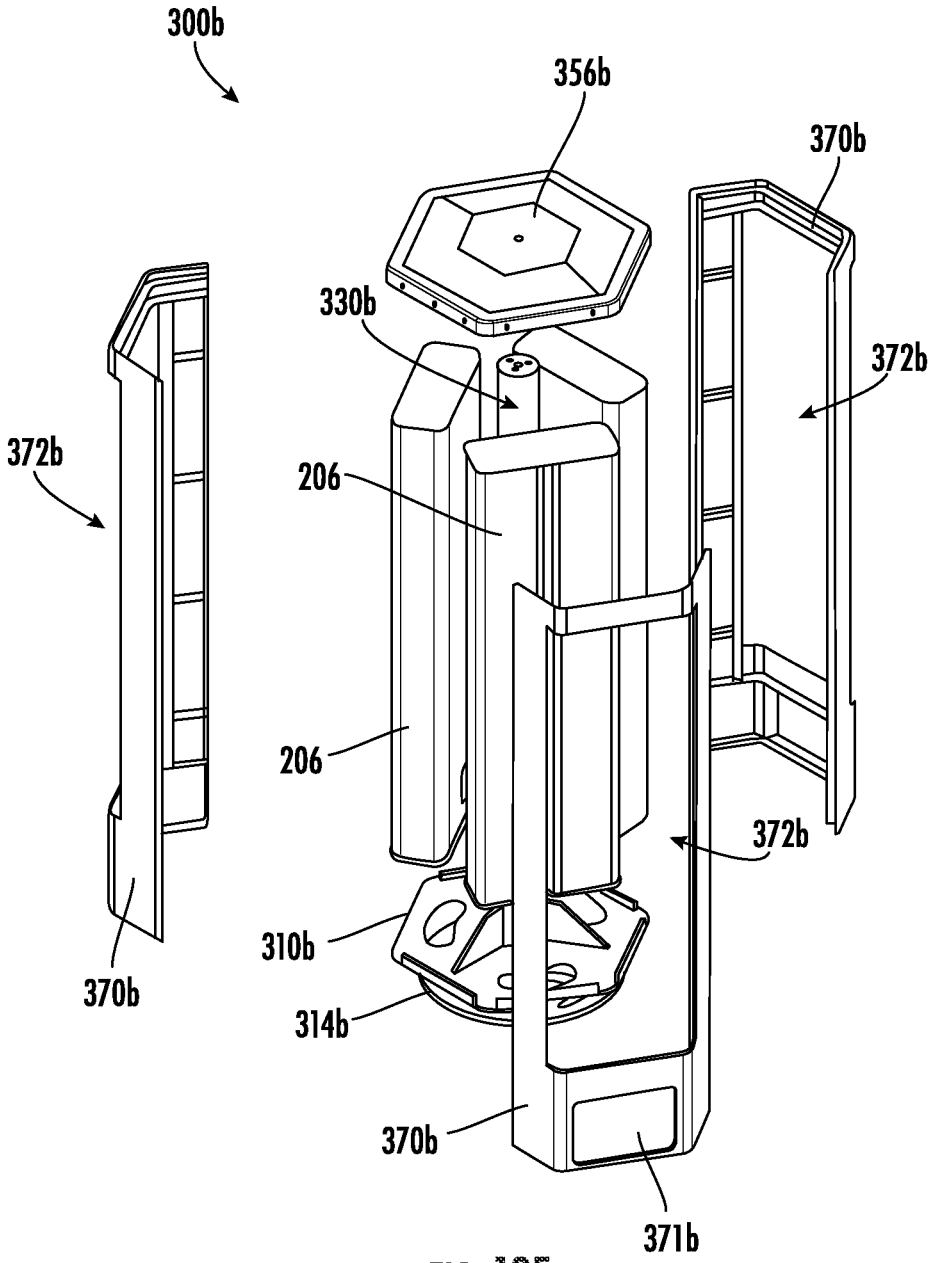
FIG. 12E is an exploded view of the passive antenna module of FIG. 12A.

As shown in FIGS. 12A-12E, similar to the active antenna module 300*a*, the passive antenna module 300*b* includes a foundation plate 314*b* and a bottom plate 310*b* that is separated from the foundation plate 314*b* by spacers 313*b* to form a gap 315*b*. The spacers 313*b* (and gap 315*b*) are configured to lift the module 300*b* slightly above a top end of the monopole 10, which will help to allow air to flow into the antenna module 300*b* (importantly, when combined with the active antenna module 300*a* in antenna module assembly 300, see, e.g., FIGS. 13A-14D). As shown in FIG. 12D, the foundation plate 314*b* includes discontinuous arcuate slots 316*b* for mounting atop the monopole 10. The foundation plate 314*b* also includes discontinuous arcuate slots 312*b* sized such that cables may be routed from the monopole 10 into the passive antenna module 300*b*. Located generally above the foundation plate 314*b*, the bottom plate 310*b* also has corresponding discontinuous arcuate slots 312*b* sized such that cables may be routed through into the passive antenna module 300*b*. For example, in some embodiments, cables (e.g., from remote radio units) may be routed from the monopole 10 through the slots 312*b* of the foundation plate 314*b*, then through the arcuate slots 312*b* of the bottom plate 310*b* to antennas 206 within the passive antenna module 300*b*. As shown in FIGS. 12D-12E, in some embodiments, the bottom plate 310*b* may be hexagonal in shape.

In some embodiments, the passive antenna module 300*b* may be sized and configured to be used on rooftop 20 deployments (see, e.g., FIG. 10). For example, in some embodiments, the foundation plate 314*b* may be configured to be mounted on a smaller monopole 10' or rooftop platform. In some embodiments, the passive antenna module 300*b* may be sized and configured to be mounted on other types of deployments such as tower deployments (e.g., telecommunication lattice towers, electricity towers, concrete poles and/or concrete towers, etc.). In some embodiments, the passive antenna module 300*b* is configured such that the active antenna module 300*a* described herein may be stacked on top of the passive antenna module 300*b* (see, e.g., FIGS. 13A-14D).

As shown in FIG. 12E, the passive antenna module 300*b* further includes a support pole 330*b* or other support member(s). In some embodiments, the support pole 330*b* is tubular (i.e., hollow) such that air may flow up through the pole 330*b*. In some embodiments, the support pole 330*b* is mounted to the upper surface of the bottom plate 310*b* and extends upwardly therefrom (see, e.g., FIG. 12E). The support pole 330*b* is mounted generally in the center on the bottom plate 310*b*, with the discontinuous arcuate slots 312*b* positioned circumferentially around the support pole 330*b*. In some embodiments, the support pole 330*b* may be open at both ends to allow air to flow in through one end (e.g., through an opening in the bottom plate 310*b*) and out the other end. The support pole 330*b* of the passive antenna module 300*b* is configured such that the support pole 330*a* (and bottom plate 310*a*) of the active antenna module 300*a* may be secured thereto.

Similar to the active antenna module 300*a*, in some embodiments, one or more shroud members (or radomes) 370*b* surround the passive antenna module 300*b* between the bottom plate 310*b* and the lower cap 356*b*. As shown in FIG. 12E, the passive antenna module 300*b* has three shroud members 370*b* (each shroud member 370*b* corresponding to an antenna 206). However, and notably, the shroud members 370*b* do not extend downwardly to cover the foundation plate 314*b*. Thus, the gap 315*b* remains open to the environment. By shielding/concealing the internal equipment of the passive antenna module 300*b* from view, the shroud members 370*b* serve to provide a more appealing aesthetic appearance to the passive antenna module 300*b*. In some embodiments, the shroud members 370*b* are formed of a polymeric material, for example, acrylonitrile butadiene styrene (ABS).

In some embodiments, each shroud member 370*b* is configured such that, when placed on the passive antenna module 300*b*, the exterior shape of the passive antenna module 300*b* is hexagonal. In some embodiments, each shroud member 370*b* may comprise a removable hatch 371*b* that allows access into the interior of the passive antenna module 300*b*. Similar to the shroud members 370*a* for the active antenna module 300*a*, in some embodiments, each shroud member 370*b* of the passive antenna module 300*b* may comprise a cut-out portion 372*b* (or "window"). Each cut-out portion 372*b* is sized and configured such that at least a portion of the antenna 206 may extend through a respective shroud member 370*b*. In some embodiments, a grommet or sealant may be used to seal and/or fill any gaps between the edges of the cut-out portion(s) 372*b* and the antennas 206, thereby preventing any moisture from entering the passive antenna module 300*b*. In some embodiments, the cut-out portions 372*b* may also allow for the introduction of a down-tilt feature for the antennas 206. For example, in some embodiments, the antennas 206 may be tilted between about 0 degrees to about 15 degrees, such that the upper portion of the antenna 206 extends radially outwardly through the window 372*b*. The sealant or grommet mentioned above may be configured such that the seal with the antenna-radio unit 200 remains even when the antenna-radio unit 200 is tilted.

Figure 13A:
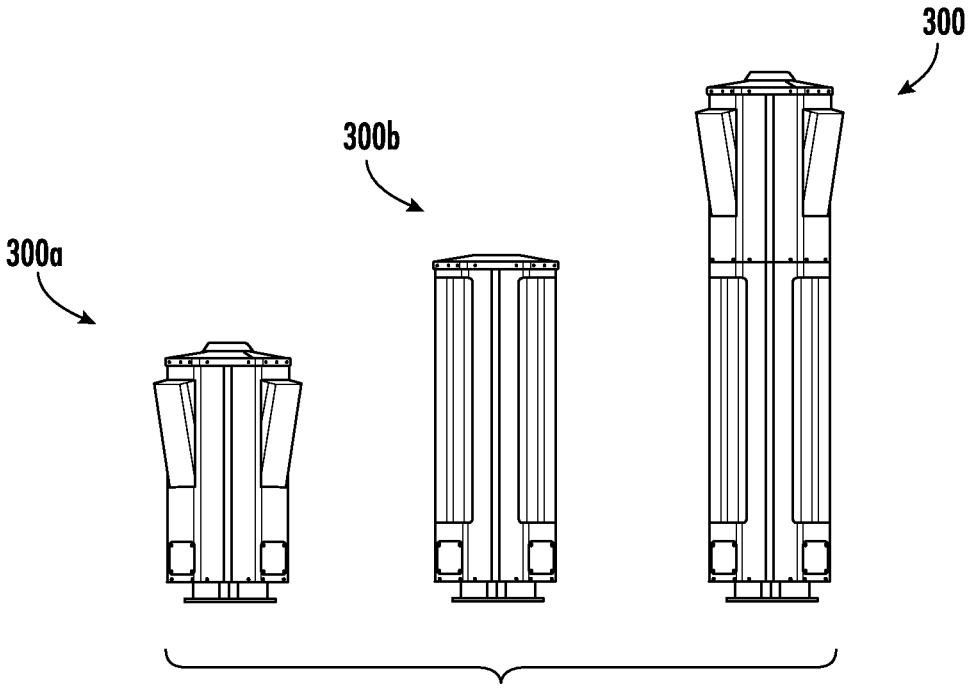
FIG. 13A illustrates how the active antenna module of FIGS. 11A-11E and the passive antenna module of FIGS. 12A-12E may be used separate from each other or, according to embodiments of the present invention, the active antenna module may be combined with (stacked on top of) the passive antenna module to form an antenna module assembly.
Figure 13B:
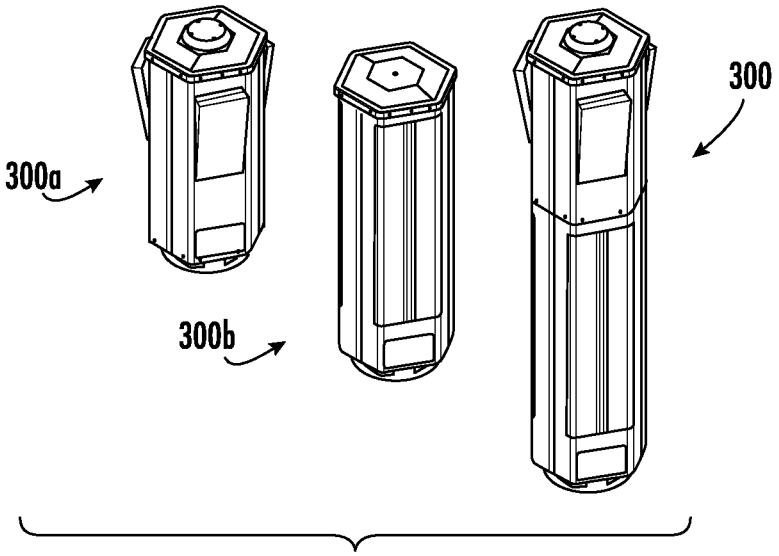
FIG. 13B is a perspective view the individual active and passive antenna modules and the combined antenna module assembly.
Figure 14A:
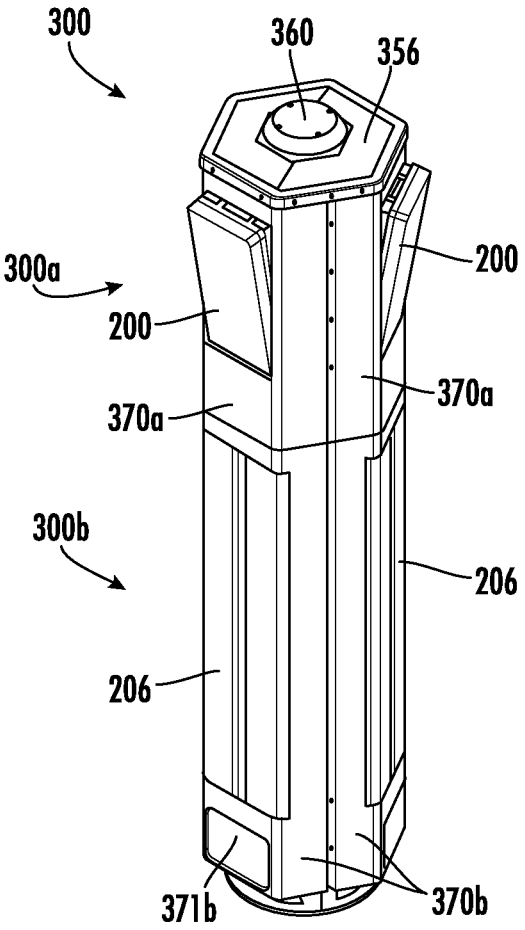
FIG. 14A is a perspective view of an antenna module assembly according to embodiments.
Figure 14B:
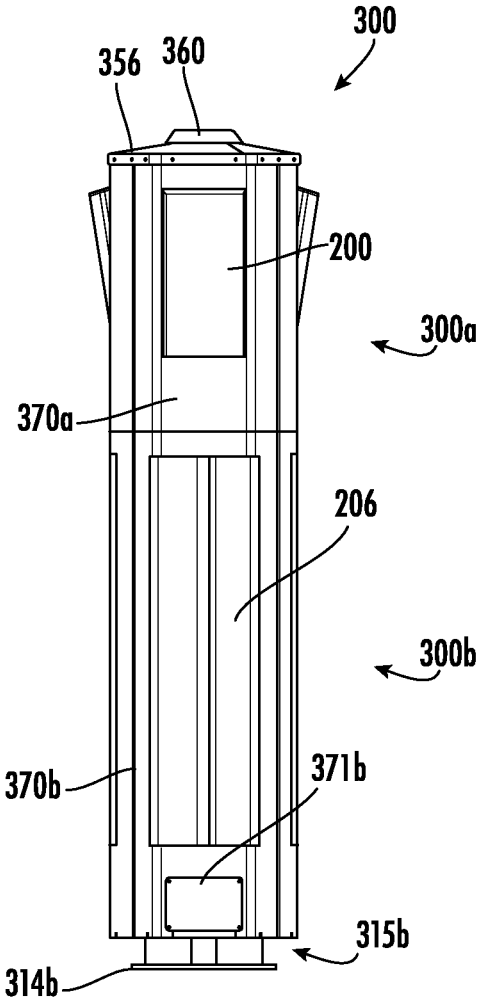
FIG. 14B is a side view of the antenna module assembly of FIG. 14A.
Figure 14C:
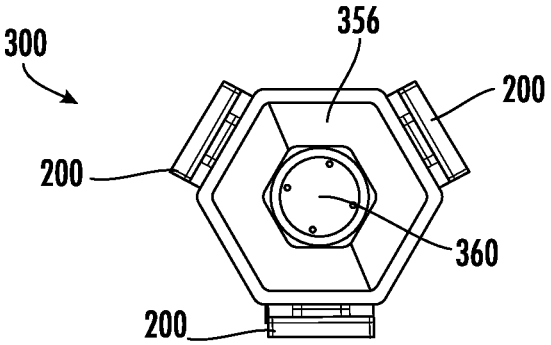
FIG. 14C is a top view of the antenna module assembly of FIG. 14A.
Figure 14D:
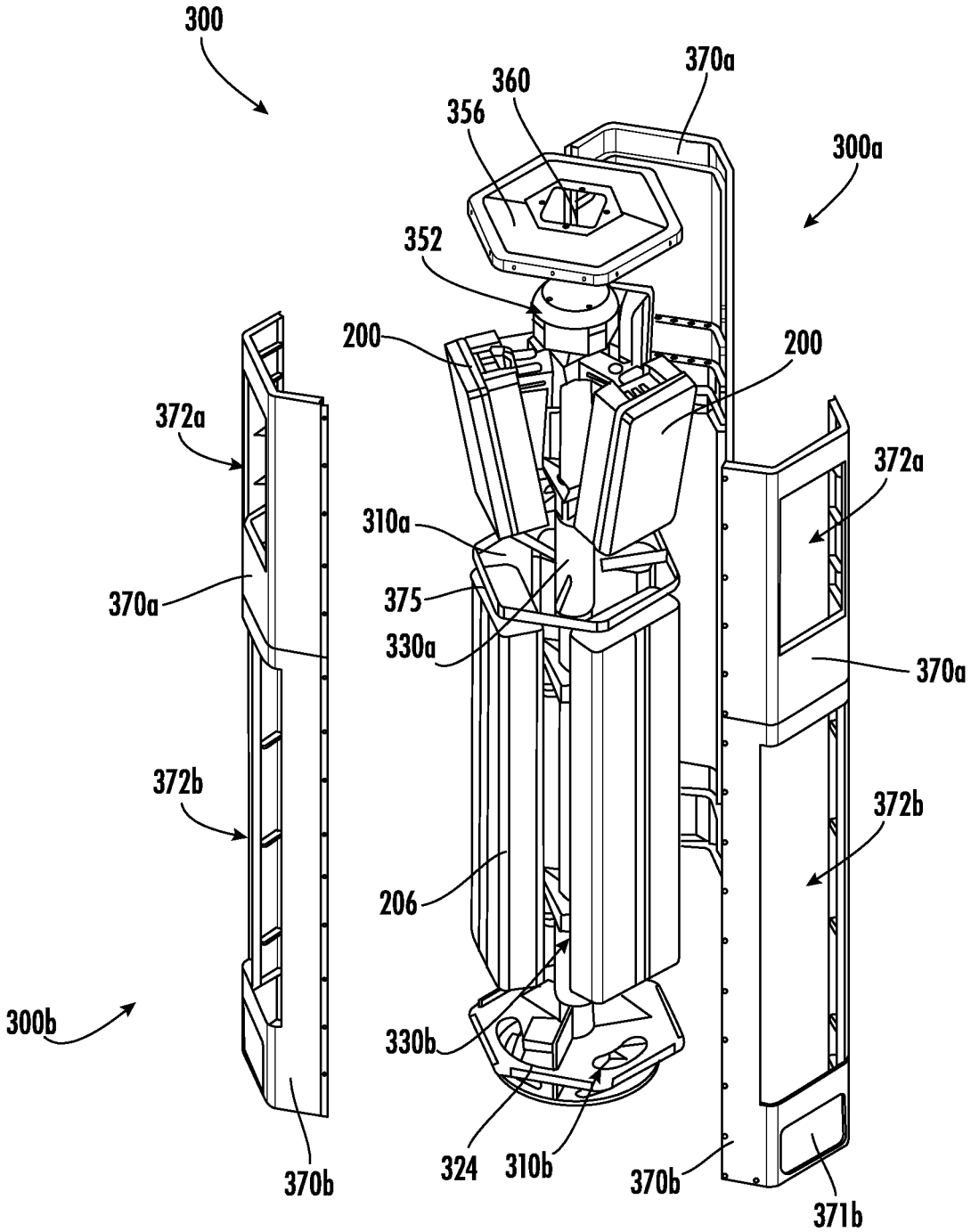
FIG. 14D is an exploded view of the antenna module assembly of FIG. 14A.

Referring now to FIGS. 13A-14D, an antenna module assembly 300 according to embodiments of the present invention is illustrated and shows the modularity of the active and passive antenna modules 300*a*, 300*b*. As shown in FIGS. 13A-13B, the active and passive modules 300*a*, 300*b* may be utilized separately as individual units or, in some embodiments, the active antenna module 300*a* may be combined with (e.g., stacked on top of) the passive antenna module 300*b* to form the antenna module assembly 300 (see also, e.g., FIGS. 14A-14D). In some embodiments, when in a stacked relationship (i.e., assembly 300), the foundation plate 314*a* may be removed from the active antenna module 300*a* and steal bands 375 may be used to hold the top and bottom shroud members 370*a*, 370*b* in position (FIG. 14D). In the stacked assembly 300, cables for the antennas 206 and the antenna-radio units 200 may be routed through the bottom plate 310*b* (e.g., from monopole 10). In some embodiments, the shroud members 370*a* surrounding the antenna-radio units 200 may have a different length in the stacked assembly 300 (FIG. 14D) than the shroud members 370*a* used on the separated active antenna module 300*a*.

The modularity of the antenna module assembly 300 and relative light weight (e.g., less than 200 pounds for the heaviest part) allows for ease of site delivery and installation. For example, the antenna module assembly 300 may be provided as a flat-packed kit that can be hand carried to rooftops through staircases and most elevators, then assembled on site. Thus, eliminating the need for crane hires, associated traffic management and/or road closure permits (e.g., due to weight and size) to move the assembly 300 to the desired rooftop site locations.

In addition, the antenna module assembly 300 provides for upgradability by allowing the passive antenna module 300*b* (e.g., having 2G, 3G, and/or 4G capability) to be deployed first at a site, then adding the active antenna module 300*a* expansion (e.g., having 5G capability), when needed. Optionally, the active antenna module 300*a* may be used separately to upgrade an existing site with 5G capability (e.g., on a separate arrangement). The modularity of the antenna module assembly 300 may also provide for streamlining operation and maintenance by making it easier to replace a faulty module 300*a*, 300*b* or upgrade an existing module 300*a*, 300*b* on site with minimal costs. Finally, the antenna module assembly 300 will support most antenna-radio units 200 (i.e., active antennas) and antennas 206 (i.e., passive antennas), thereby allowing greater flexibility for services providers.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed:

1. An antenna module assembly, the assembly comprising:

a passive antenna module, the passive antenna module comprising:

three passive antennas;

a foundation plate configured for mounting to a structure;

a bottom plate mounted above the foundation plate to form an air gap;

a first support member extending upwardly from the bottom plate, wherein the three passive antennas are mounted to the first support member; and three shroud members that together surround the passive antennas; and an active antenna module, the active antenna module comprising:

three antenna-radio units, each antenna-radio unit comprising an antenna and a radio transceiver in an integrated unit;

a second bottom plate;

a second support member extending upwardly from the second bottom plate, wherein the antenna-radio units are mounted to the second support member;

an upper plate mounted to an upper end of the second support member;

a fan unit mounted to the upper plate; and three shroud members that together surround the antenna-radio units, wherein the active and passive antenna modules are configured such that the modules may be mounted to a structure and used as separate units, or the active antenna module may be combined with the passive antenna module in a stacked relationship.

2. The antenna module assembly of claim 1, wherein, when together, the shroud members surrounding the passive antenna module and the active antenna module are hexagonal.

3. The antenna module assembly of claim 1, wherein each shroud member comprises a cut-out portion sized and configured such that at least a portion of a respective antenna or antenna-radio unit extends through the shroud member.

4. The antenna module assembly of claim 1, wherein at least one of the antennas or antenna-radio units is configured to be down-tilted.

5. The antenna module assembly of claim 1, wherein, when the active antenna module is to be mounted to a structure as a separate unit, the active antenna module further comprises a foundation plate configured for mounting to the structure and the bottom plate is mounted above the foundation plate to form an air gap.

6. An antenna module assembly, the assembly comprising:

a passive antenna module, the passive antenna module comprising:

three passive antennas;

a foundation plate configured for mounting to a structure;

a bottom plate mounted above the foundation plate to form an air gap;

a first support member extending upwardly from the bottom plate, wherein the three passive antennas are mounted to the first support member; and a shroud member sized and configured to surround the passive antennas, wherein the shroud member comprises three cut-out portions, each cut-out portion corresponding to a respective passive antenna and is configured such that at least a portion of the passive antenna extends through the cut-out portion; and an active antenna module, the active antenna module comprising:

three antenna-radio units, each antenna-radio unit comprising an antenna and a radio transceiver in an integrated unit;

a second bottom plate;

a second support member extending upwardly from the second bottom plate, wherein the antenna-radio units are mounted to the second support member;

an upper plate mounted to an upper end of the second support member;

a fan unit mounted to the upper plate; and a shroud member sized and configured to surround the antenna-radio units, wherein the shroud member comprises three cut-out portions, each cut-out portion; corresponding to a respective antenna-radio unit and is configured such that at least a portion of the antenna-radio unit extends through the cut-out portion;

wherein the active and passive antenna modules are configured such that the modules may be mounted to a structure and used as separate units, or the active antenna module may be combined with the passive antenna module in a stacked relationship.

7. The antenna module assembly of claim 6, wherein the shroud members surrounding the passive antenna module and the active antenna module are hexagonal.

8. The antenna module assembly of claim 6, wherein at least one of the antennas or antenna-radio units is configured to be down-tilted.

9. The antenna module assembly of claim 6, wherein, when the active antenna module is to be mounted to a structure as a separate unit, the active antenna module further comprises a foundation plate configured for mounting to the structure and the bottom plate is mounted above the foundation plate to form an air gap.

10. The antenna module assembly of claim 6, wherein the passive antennas are configured to be connected with a radio transceiver mounted outside the module.

11. The antenna module assembly of claim 6, further comprising a fan controller operatively connected with the fan to control operation of the fan.

12. The antenna module assembly of claim 11, wherein the fan controller controls the fan based on temperature.

13. The antenna module assembly of claim 6, wherein the first and second support members are hollow and configured to permit air inflow.

14. The antenna module assembly of claim 6, wherein the module further comprises gussets configured to direct airflow into active and/or passive antenna modules.

15. The antenna module assembly of claim 1, wherein the passive antennas are configured to be connected with a radio transceiver mounted outside the module.

16. The antenna module assembly of claim 1, further comprising a fan controller operatively connected with the fan to control operation of the fan.

17. The antenna module assembly of claim 16, wherein the fan controller controls the fan based on temperature.

18. The antenna module assembly of claim 1, wherein the first and second support members are hollow and configured to permit air inflow.

19. The antenna module assembly of claim 1, wherein the module further comprises gussets configured to direct airflow into active and/or passive antenna modules.

20. An antenna module assembly, the assembly comprising:

a passive antenna module, the passive antenna module comprising:

three passive antennas;

a foundation plate configured for mounting to a structure;

a bottom plate mounted above the foundation plate to form an air gap;

a first support member extending upwardly from the bottom plate, wherein the three passive antennas are mounted to the first support member; and a hexagonal shroud member sized and configured to surround the passive antennas, wherein the shroud member comprises three cut-out portions, each cut-out portion corresponding to a respective passive antenna and is configured such that at least a portion of the passive antenna extends through the cut-out portion; and an active antenna module, the active antenna module comprising:

three antenna-radio units, each antenna-radio unit comprising an antenna and a radio transceiver in an integrated unit;

a second bottom plate;

a second support member extending upwardly from the second bottom plate, wherein the antenna-radio units are mounted to the second support member;

an upper plate mounted to an upper end of the second support member;

a fan unit mounted to the upper plate; and a hexagonal shroud member sized and configured to surround the antenna-radio units, wherein the shroud member comprises three cut-out portions, each cut-out portion corresponding to a respective antenna-radio unit and is configured such that at least a portion of the antenna-radio unit extends through the cut-out portion;

wherein the active and passive antenna modules are configured such that the modules may be mounted to a structure and used as separate units, or the active antenna module may be combined with the passive antenna module in a stacked relationship, wherein at least one of the antennas or antenna-radio units is configured to be down-tilted.

* * * * *